US005312107A

United States Patent [19]

Gvoich et al.

[11] Patent Number: 5,312,107

[45] Date of Patent: May 17, 1994

[54] GOLF CLUB SWING TRAINING AND EXERCISE DEVICE

[75] Inventors: Ned Gvoich, Beamsville; John S. Moroz, Dundas, both of Canada

[73] Assignee: Kordun, Ltd., Studio City, Calif.

[21] Appl. No.: 30,628

[22] Filed: May 13, 1993

[51] Int. Cl.[5] ..... A63B 21/24; A63B 21/22

[52] U.S. Cl. ..... 273/186.1; 482/8; 482/112; 482/118; 482/902; 273/191 A; 73/379.09

[58] Field of Search ..... 273/186.1, 191 R, 191 A, 273/191 B, 192; 482/6, 5, 7, 109, 111, 112, 113, 118, 119, 146, 147, 902, 8; 73/379.09

[56] References Cited

U.S. PATENT DOCUMENTS

| | | | |
|---|---|---|---|
| 1,983,920 | 12/1934 | Perin | 273/35 |
| 2,328,408 | 8/1943 | Beil et al. | 273/35 |
| 2,472,065 | 6/1949 | Cottingham | 273/35 |
| 2,626,151 | 1/1953 | Jenks | 273/35 |
| 3,319,963 | 5/1967 | Cockburn | 273/186 |
| 3,415,523 | 12/1968 | Boldt | 273/186 |
| 3,614,108 | 10/1971 | Garten | 273/190 R |
| 3,738,661 | 6/1973 | Moller | 273/191 R |
| 3,926,430 | 12/1975 | Good, Jr. | 272/79 C |
| 4,261,573 | 4/1981 | Richards | 273/191 R |
| 4,486,020 | 12/1984 | Kane et al. | 273/191 R |
| 4,758,000 | 7/1988 | Cox | 273/190 R |
| 4,869,492 | 9/1989 | Joutras | 482/118 X |
| 4,869,498 | 9/1989 | Wolf et al. | 482/113 |
| 5,050,874 | 9/1991 | Fitch | 272/136 |

*Primary Examiner*—George J. Marlo
*Attorney, Agent, or Firm*—Small Larkin & Kidde

[57] ABSTRACT

A golf swing training and muscle exercising device for a full-range of motion golf swing including a rotatable ring rotatable within a stationary ring; a golf club holder sub-assembly for providing hydraulic isokinetic resistance to rotation of the rotatable ring; and an electronic monitoring sub-assembly.

27 Claims, 16 Drawing Sheets

350
352
342
344
348
346
318
319
340
330
334
336
332
360
370
364
372
366
374
386
392
362
380
388
390
384
382
430
432
338
80
176
170
174
172
162
168
200
160
164
166
163
50
161
154
152
150
165
153
151
131
135
40
133
125
144
129
122
146
121
114
116
120
126
145
112
118
140
142
141

GOLF CLUB SWING TRAINING AND EXERCISE DEVICE

BACKGROUND OF THE INVENTION

Field of The Invention

The present invention relates to a swing training and muscle exercising device which assists the user in developing a full range of motion swing enabling the user to consistently and efficiently transfer power at the instant of contacting a stationary object, such as a golf club to a golf ball. Persistent usage of the device can strengthen the muscles used in the swing and also reinforce myoneural "muscle memory." Although the principles of the invention can be adapted to other sports or activities where a swinging motion is employed, the preferred embodiment is adapted for use as a golf swing training device. Consequently, the preferred embodiment of the invention described herein is directed to a golf swing training and exercising device.

The optimum golf swing provides for maximum distance and accuracy of the golf shot. This is achieved when the golf swing maintains an appropriate swing plane along a determinable inside and outside swing path (inside of the parallel plane of a line directed through the golf ball to the target). The body's muscles create, store and release energy squarely to a golf ball. The physiological components of the optimum golf swing include physical agility, flexibility, strength, power, muscular endurance, balance, coordination, leverage through good posture and hand-to-eye coordination. When all of these physical attributes are integrated with the optimum golf swing mechanics, maximum club head speed and transference of energy to a golf ball is realized.

The optimum golf swing is a fluid timed motion which optimizes power, coordination and speed of a user's swing to deliver an impact to the ball to achieve desired distance and accuracy. This motion is linked through eight critical phases of movement.

Executing an ideal, total, full-range of motion golf swing entails performing complex combinations of separate motions, or portions, during eight sequential phases: (1) the set-up phase, (2) the takeaway phase, (3) the top of the swing phase, (4) the downswing phase, (5) the hitting zone phase, (6) the impact phase, (7) the release phase, and (8) the follow-through phase.

1. The Set-Up Phase

The first phase, the set-up phase, is the initial stance the golfer takes to strike the ball as illustrated in FIG. 18. An effective set-up requires balance and effective posture to set the trunk and limbs of the body in the most mechanically advantageous position with the body weight slightly favoring the left foot in the right to left golf swing. In the set-up phase, the golfer aligns the club head with the ball and a pre-selected target as illustrated by the imaginary line 113 in FIG. 18. Imaginary line 113 defines two regions. The first region is the side of the line on which the golfer stands facing the ball. This first region is referred to as the "inside," and the region on the opposite side of line 113 is referred to as the "outside." Thus, when a golfer's swing is described as an "inside to outside" swing, the club head travels in a path, termed the "swing path," from the inside region before impact with the ball, to impact with the ball at line 113, and then in a path in the outside region after impact.

2. The Takeaway Phase Or Backswing

In the second phase, the takeaway phase, as illustrated in FIG. 19, the golfer shifts the body weight to favor the right foot and initiates the backswing with the large muscles of the legs and trunk. A triangle formed by the position of shoulders and hands allows the golfer to perform a one-piece takeaway, drawing the club back along the appropriate swing plane to match the selected golf club and along a determinable inside-to-outside or outside-to-inside swing path. The swing plane(s) are illustrated in FIG. 15 as the planes in which the golfer's hands move 560 and the plane in which the club head moves 570 comprising two parallel planes. The swing plane is dependent upon the individual anatomical variants of the golfer and the selected club length. The taller golfer will stand closer to the ball and therefore have a steeper swing plane. The shorter club will also require the golfer to stand closer to the ball and thereby require a steeper swing plane as illustrated in FIG. 15, the angle $\alpha$ between the planes 560 and 570 with the horizontal become larger as the swing planes 560 and 570 become more upright.

3. The Swing Phase

In the third phase of the swing, the top of the swing phase, the club is posted with the club shaft approximately parallel to the ground, as seen in FIG. 20, and the club head pointing back directly at the target. The left arm remains relatively straight and the right arm is folded at the elbow. The back forearm is supinated, i.e., rotated counterclockwise for a right-handed golfer or rotated clockwise for a left-handed golfer, and the front forearm is pronated, i.e., rotated clockwise for a right-handed golfer or rotated counterclockwise for a left-handed golfer. In the right-handed golfer, the right wrist is cocked back in extension. The golfer's body coils wherein the shoulders have turned back more than twice as much as the hips which are turned back more than twice as much as the knees. The body has been wound from the top down with the upper body turned back against the resistance of the lower body and poised to enter phase four, the downswing phase.

4. The Downswing Phase

In the downswing phase, the club is pulled into action by the uncoiling of the large muscles of the body. It is the timely unwinding of the downswing phase, while maintaining the appropriate swing plane and predetermined swing path, that produces the optimum golf swing. Pulling the club out of the swing path alters the angle at which the club head meets the ball and thereby alters the flight path of the ball. It is therefore important for a golfer to develop a consistent swing path within a consistent swing plane to achieve optimum results. A further problem that occurs during the downswing phase is referred to as casting of the club, wherein the angle formed between the club and the two arms is drastically increased. Casting the club results in a deviation from the swing plane and adversely affects both the power and speed of the club producing a weak shot.

5. The Hitting Zone Phase

In the fifth phase, the hitting zone phase, as seen in FIG. 22, the golfer attempts to get the hands as close as possible to being in-line directly above the ball while still maintaining the angle $\beta$ formed at set-up between the club shaft and the arms, the right wrist remains cocked and the back arm remains folded so that the stored energy of the swing is maintained until impact with the ball to ensure maximum energy transference from the club head to the ball.

6. The Impact Phase

In the sixth phase, the impact phase, as seen in FIG. 23, the club head is accelerated by a whipping action created by the straightening of the right arm, pronation of the right forearm and uncocking of the right wrist in a timely manner at a fixed point corresponding to the impact with the ball.

7. The Release Phase

In phase seven, the release phase, the right hand has turned over the left hand so that the club points toward the target. This ensures complete expenditure of the energy.

8. The Follow-Through Phase

In phase eight, the follow-through phase, the arms, trunk and body continue, by momentum, in the swing plane and path to complete the effective golf swing.

The optimal golf swing training device should have the ability to activate and train the trainable physiological components of the swing since they are inseparable and co-dependent. Sports-specific flexibility training is accomplished by the full range of motion movements comprising the physical task. Strength and power training requires exercise against a resistance, while muscular endurance requires repetition of the activity. Good balance is developed through repetitive proprioceptive training movements. Improved leverage is developed when the golfer adopts an effective sports-specific posture. Hand-to-eye coordination is improved by focused concentration and repetitive accomplishment of the task. Agility and coordination result from the integration of all the physiologic components of the movement.

Description Of The Related Art

Many attempts have been made to provide golf swing training and/or exercising devices to assist the golfer in developing an effective golf swing and in the strengthening of the muscles attuned to the golf swing. Known golf swing training and/or exercising devices implement restrictive control of the golfer's body movement, restrictive control of the golf club or restrictive control of a handle attachment in place of the golfer's club and/or combinations thereof. Since the golf swing is an individually varying movement, the restrictive control of the golfer, the golf club or a handle attachment is not a desirable feature.

U.S. Pat. No. 5,050,874 to Fitch attempts to achieve both objectives in a device where a user executes a simulated golf swing by rotating a parabolic-shaped arm against a spring-loaded resistance mechanism which offers minimum resistance when the swing motion is in the proper plane. However, this device has major inadequacies whose significance will be evident from the foregoing discussion, and which may be summarized as follows: restricting the swing to only a portion of a realistic full-range of motion golf swing; not providing means of visualizing the relationship of a club, from grip to club head, to the ball; pulling the user back into the top of the swing instead of allowing proper torsion of the shoulders, upper torso and hips; not adjusting for clubs of different length; not providing means to adjust swing plane and/or swing path; not providing means for delivering resistance to the large muscles of the trunk and legs for unwinding torsion in the upper body from the top down; not providing means of altering swing resistance at any point in the swing or throughout the full range of motion; and not providing indication of power, force or speed achieved during the various phases of a swing.

Another device which attempts to combine golf swing training with strengthening muscles used in the swing is U.S. Pat. No. 3,614,108 to Garten. The user swings a simulated golf club handle pivotally attached to an arm rotatably connected to a wall-mounted plate having adjustable inclination and adjustable frictional resistance, the arm rotating about an axis normal to the plate. In addition to having all the inadequacies of the Fitch device, the Garten device constrains the swing path to a circular arc rather than an eccentric arc as required for an ideal golf swing, and unrealistically generates resistance during the takeaway phase of the swing.

Yet another device which attempts to combine golf swing training with muscle strengthening is manufactured by Perfect Swing Trainer, Inc. of Orlando, Fla. A user swings a golf club while standing within a stationary planar ring. The ring is adjusted in inclination so as to match the inclination of the user's swing plane, and is adjusted in height so that the lowermost portion of the ring matches the club's "balance point", i.e., its center of mass. The user must maintain continuous contact between the club shaft and the ring during both the takeaway and the downswing. The club head is thereby constrained to move in a plane parallel to and near the ring plane. Optionally, an elastomeric cord may be attached between a point on the ring to one or the other of the user's hands. The particular hand and point of ring attachment determine which shoulder and arm muscles can be exercised during which segment of the swing.

Inadequacies of the Perfect Swing TM device include: The inability to set a proper swing path; failure to provide a resistance through the full range of motion, and failure to provide feedback to the golfer with respect to the exercise function of the device.

U.S. Pat. No. 3,926,430 to Good, Jr. is directed to a device for exercising the principal sets of muscles used to play golf against a resistance force, while moving the muscles to simulate the manner in which they are moved during an actual golf swing. This device avoids the deficiencies of friction-type resistance units, viz., unpredictable jerkiness, maximum rather than minimum resistance at the beginning of a swing motion, and difficulty in accurately adjusting the resistance force during and throughout the swing motion, by incorporating a hydraulic torque resistance unit. A user manipulates a handle connected to a rotatable shaft extending axially from a hydraulic chamber which generates a progressively and smoothly increasing resistance torque as the rotational speed of the shaft increases. However, this device unrealistically delivers resistance in both directions of the golf swing, and does not train the swing, serving solely as an exercise device.

Other devices limited to training a golf swing are disclosed in: U.S. Pat. No. 4,486,020 to Kane et al.; U.S. Pat. No. 4,758,000 to Cox; U.S. Pat. No. 4,261,573 to Richards; U.S. Pat. No. 3,415,523 to Boldt; U.S. Pat. No. 3,319,963 to Cockburn; U.S. Pat. No. 2,626,151 to Jenks; U.S. Pat. No. 2,318,408 to Beil et al.; and U.S. Pat. No. 1,983,920 to Perin.

In view of the limitations of the above-cited devices, there has been a need for a device and/or technique whereby a user, whether he or she is a novice golfer, an intermediate golfer or an advanced golfer, can train the skills required for an effective golf swing. These skills include the grooving of the full range of motion swing plane and swing path and the timed linking of the eight phases of the golf swing to thereby deliver the maximum power at the point of impact of the club head with the ball, more commonly referred to as the swing tempo. Furthermore, there has been a need for a device that is sports-specific wherein the golfer utilizes his own clubs and actually strikes a ball. There has also been a need for a device that can exercise and thereby strengthen the muscles required to execute the golf swing and improve coordination and balance physiology of the golfer. There has also been a need for a device that provides a feedback to the golfer relating to his or her golf swing performance, thereby further enhancing learning.

OBJECTS OF THE INVENTION

Accordingly, it is an object of the present invention to provide a device which trains a user to sequentially execute during a full-range of motion golf swing, movements of the feet, legs, hips, trunk, shoulders, arms and hands, in tempo and rhythm, which result in optimum club head speed and clubface-to-ball alignment at the instant of impact.

A further object of the invention is to provide a device which enables a user to swing a golf club within a predetermined swing plane which is adjustable so as to accommodate differences in physiological characteristics, swing style, address posture, and club length.

Yet another object of the invention is to provide a device which enables a user to perform a full-range of motion golf swing without encountering mechanical limitations and/or without visually obstructing the club head.

A further object of the invention is to provide a device which enables a user to execute a full-range of motion golf swing wherein the club head traverses an optimum, non-circular swing path within a predetermined swing plane, so as to impact a ball pre-positioned with respect to the user, as during actual play on a golf course.

A still further object of the invention is to provide a device which enables a user to adjust a swing path with respect to a predetermined target line so as to achieve at impact a "fade," a shot directly along the target line, or a "draw".

Another object of the invention is to provide a device which enables tailoring a full-range of motion swing for each of a user's wood and iron golf clubs.

Yet another object of the invention is to provide a device which enables a user to exercise the muscles used in executing a full-range of motion sport swing.

A further object of the invention is to provide a device which provides automatically accommodating resistance during a downswing as a user applies increasing force, thereby training the muscles used during the swing by reinforcing the corresponding neurological pathways.

Another object of the invention is to provide a means of adjusting and controlling movement speed through the complete range of motion for training golf-specific muscles to develop strength, power and endurance.

Yet a further object of the invention is to train a user to execute an inside-to-outside swing path during both the takeaway and downswing phases, so as to distribute biomechanical stresses evenly throughout the spinal segments.

Still another object of the invention is to provide feedback information from which a user can determine how effectively each swing phase was performed, and how well the separate phases melded into a total swing pattern.

Another object of the invention is to provide a device that is simple, reliable, easy to use, and easy to maintain.

One more object of the invention is to provide a device that is relatively simple and inexpensive to manufacture.

Other objects of the invention will become evident when the following description is considered with the accompanying drawings.

SUMMARY OF THE INVENTION

The present invention overcomes inadequacies of conventional golf swing training and exercising techniques and/or devices by providing a device that enables a user to execute a normal, full range of motion golf swing at an appropriate pre-selected movement velocity. If the user attempts to increase the velocity of the rotating ring beyond the selected value, the mechanism effectively resists this change and provides resistance to the swing equal to the applied force so that swing velocity remains constant. In this way, the user automatically controls the intensity of the exercise, by adjusting the force he or she applies to the rotating ring, to a level that is suited to his or her fitness level. As the user's strength increases, he or she can increase the force applied to the rotating ring and its resistance system and thereby increase the training effect. Furthermore, because the resistance automatically accommodates to the user's strength throughout the full range of motion of the swing, the training effects are optimized at all joint and body positions, i.e., resistance profiles the user's "strength curve."

An additional feature of the current invention is its sports-specific design. Exercise physiologists and biomechanists for many years have endorsed the concept of optimal training benefits while training on equipment that accurately simulates the sporting activity. The current design allows the user to perform a normal golf swing while allowing unobtrusive guiding of the user's club and body movements and provides optimum training resistance throughout the complete range of motion of the swing.

The device includes adjustments enabling the user to execute a full range of motion swing with any of his or her clubs in a selectable swing plane and swing path tailored to his or her physiological characteristics, stance when addressing the ball, and preference for fading a shot, hitting the ball along the target line, or drawing the shot. The adjustments enable the club head to be moving in a swing path and swing plane such that the club head will impact the ball pre-positioned as for an actual golf shot.

The device also measures and displays the force generated by the user (via the club) at selected intervals along the swing path, including downswing phase, hitting zone phase and at impact phase. These force measurements are calibrated and stored electronically and provide an accurate profile of the user's strength throughout each golf swing. Furthermore, by determining the time interval between sequential magnetic switch triggers and knowing the angular distance between magnets on the rotating ring, angular velocity and angular acceleration can be computed, stored and displayed electronically. From these data, other significant data such as applied torque, power and work can easily be derived, stored and displayed. From the display of these measurements, the user can gauge his or her progress in achieving proper body coordination, tempo, rhythm and power as, through repetition, the swing is neurologically grooved and the muscles are strengthened. The display of these measurements permits the user to compare the attributes of his or her golf swing to those of the professional golfer, thereby establishing a training objective to accomplish.

In more detail, a preferred embodiment of the present invention comprises a base sub-assembly including: a circular platform frame having a circumferential tubular member; a circular platform cover having a downwardly extending outer edge forming an annular lip, the cover diameter such that the lip snaps over or otherwise closely receives the circumferential tubular member; and generally vertical, diametrically opposite, first and second stanchion brackets, each rigidly attached at a lower portion to the circumferential tubular member.

The preferred embodiment further comprises a generally vertical first (or lower) stanchion sub-assembly including: a first arcuate member rigidly attached to the first bracket, a second arcuate member closely received by and slidable with respect to the first tubular member and having a slotted upper portion, and a locking pin for fixing the position of the second tubular member relative to the first tubular member; a transversely compressible, bifurcated first (or lower) clamp closely received and pivotable within the slotted upper portion of the second tubular member; a first (or lower) axle having a lower portion and an upper end, the lower portion closely received within the lower clamp and axially rotatable when the clamp is not under transverse compression; and a locking bolt for fixing the angle of pivot of the lower clamp with respect to the slotted upper portion of the second tubular member, and fixing the axial disposition of the lower axle relative to the lower clamp.

The preferred embodiment further comprises a ring sub-assembly including: a stationary ring-shaped angle member having first and second mutually orthogonal flanges, the upper end of the lower axle rigidly attached to the second flange; and a circular tubular member closely received by, and in the absence of an external frictional force, freely rotatable within a right-angle recess formed by the first and second flanges. The rotatable tubular member is retained within the recess by a plurality of retainer clips.

The preferred embodiment further comprises a club-holder sub-assembly including first and second lath-shaped frame members each having a first end rigidly connected to the rotatable arcuate member, and a second end rigidly attached to a housing with a longitudinal bore. The frame members are symmetrically disposed so as to constitute two legs of a triangle with the housing at its apex, the plane of the triangle being offset at an angle of about 20 degrees from the plane of the ring sub-assembly. A shaft having a swivel connector at a distal end is slidably disposed within the housing. A "U"-shaped member including a base and first and second legs is connected at the base to the swivel connector. A cross-piece member is transverse to and slidably disposed upon the legs of the U-shaped member, so as to determine a bounded planar opening. The U-shaped member and cross-piece member thus comprise a retainer for a club shaft. A golf club having a stop member rigidly connected at a selectable position along the club shaft is disposed so that the shaft passes through the retainer opening with the stop member on the distal side of the opening. The cross-sectional area of the stop member is larger than the area of the planar opening. The slidable shaft and the club shaft stop member are adjustably positioned so that when the user "posts" the club at the top of the swing, the stop member contacts the club shaft retainer. Thus, as the user begins the downswing, torque generated in the club shaft is transmitted by frictional contact between the stop member and the club shaft retainer via the frame members to the rotatable arcuate member, resulting in a rotation of the arcuate member within and relative to the stationary ring-shaped member. The club shaft is disposed neither in the plane of the ring sub-assembly nor in the plane of the club holder sub-assembly. However, when the arcuate member rotates, the club head is constrained to move along a path in a plane which is substantially parallel both to the ring sub-assembly plane and to a plane in which the distal end of the shaft moves. Thus, the club head moves in a swing path substantially in a plane that is parallel to but offset from the ring plane so that the club head can contact a ball pre-positioned at address.

The preferred embodiment further comprises a generally vertical second (or upper) stanchion sub-assembly including: a tubular member rigidly attached at a lower end to the second bracket, and having a slotted upper portion; an elongated member of a predetermined length, disposed generally transverse to the tubular member, and having a longitudinally disposed slot extending over about two-thirds of the length, and having a longitudinal notch at an end proximal to the ring sub-assembly; a transversely compressible, bifurcated second (or upper) clamp closely received and pivotable within the proximal notch; a second (or upper) axle having an upper portion and a lower end, the upper portion closely received within the upper clamp and axially rotatable when the clamp is not under transverse compression; a first locking bolt for fixing the angle of pivot of the upper clamp and fixing the axial disposition of the upper axle; and a rectangular box-shaped housing rigidly attached to the stationary ring-shaped angle member by first and second mounting brackets. The lower end of the upper axle is rigidly attached to the box-shaped housing at a position diametrically opposite to the attachment position of the upper end of the lower axle. The elongated member is disposed in a generally vertical plane within the slotted upper portion of the tubular member, and is constrained to slide relative to and/or pivot about a second locking bolt passing through the longitudinal slot.

The preferred embodiment further comprises a hydraulic resistance sub-assembly including: a hydraulic pump mounted within the housing; a drive-shaft connected to a drive-gear of the pump; a one-way clutch rotatably attached to the drive-shaft; a governor wheel; a rigid conduit for hydraulic fluid connecting the outlet and inlet ports of the gear pump so as to comprise a closed system; a flow restricting valve within the rigid conduit connected between the inlet port and the outlet port; a piezoresistive pressure transducer; and a flexible conduit filled with hydraulic fluid connected to the transducer.

In the current invention, the user generates a tangential force on the rotating ring which causes the ring to rotate. This ring is directly coupled to the input shaft of the hydraulic pump. Therefore, as the ring rotates, the input shaft of the pump will also rotate and force fluid to flow within the pump.

The rate at which hydraulic fluid can flow within this closed system is regulated by the size of the aperture of the flow-restricting valve. Since the rate of hydraulic flow regulates the speed at which the pump shaft rotates, it follows that the aperture size will govern pump speed and hence rotating ring speed.

When the valve aperture is closed, hydraulic fluid cannot flow in the system and pump speed will be zero. If the user applies a force to the rotating ring, which drives the pump, no movement will occur. However, pressure will increase within the pump in direct proportion to the magnitude of the applied force. Small valve apertures will allow relatively low pump speeds. Conversely, large valve apertures will result in high pump speeds. As the user attempts to increase the speed of the rotating ring beyond the speed set on the aperture valve, the pump will resist this speed increase and pressure will increase within the pump. It is this resistance to speed change that provides the isokinetic training benefits detailed previously. Monitoring the increase in pressure within the pump provides the user with quantitative information on the forces he or she is generating.

The preferred embodiment further comprises an electronic monitoring sub-assembly which includes: a force monitoring and readout display electronic circuit; a magnetic switch disposed on an interior surface of the first flange of the ring-shaped angle member; a plurality of permanent bar magnets disposed on an outer surface of the rotatable tubular member; a digital display voltmeter; and direct current power sources for the pressure transducer, electronic circuit, magnetic switch, and voltmeter. The electronic circuit buffers, amplifies and samples the electrical signals generated by the pressure transducer. For each instance during the downswing when a bar magnet transits the magnetic switch, the electronic circuit sends the signal representing the force value at that point in the downswing to the digital voltmeter for recordal and numerical display.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

I. Introduction

Figure 1:
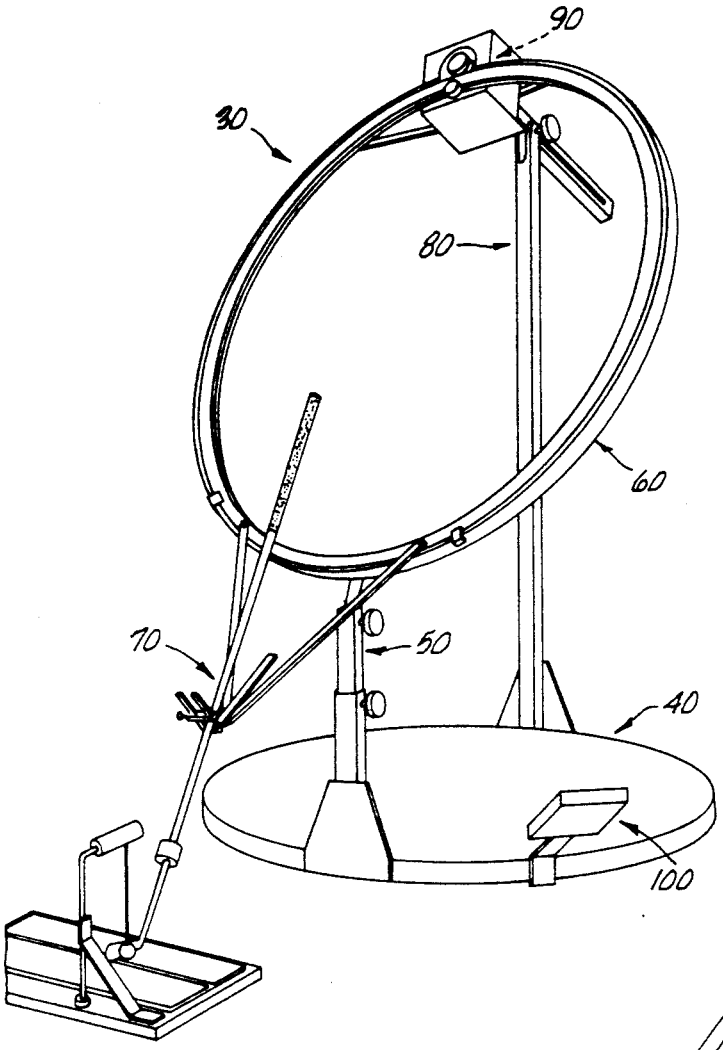
FIG. 1 is a perspective view of a preferred embodiment of the present invention adapted for use as a golf swing training device.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

II. Complete Assembly and Sub-assemblies

A. Complete Assembly

As shown in FIGS. 1–4, a swing training and muscle exercising device 30 includes a generally horizontal base sub-assembly 40, a generally vertical first (or lower) stanchion sub-assembly 50, a planar ring sub-assembly 60, a club-holder sub-assembly 70, a generally vertical second (or upper) stanchion sub-assembly 80, a hydraulic resistance sub-assembly 90, and an electronic monitoring sub-assembly 100.

B. Base Sub-Assembly

Figures 5, 8:
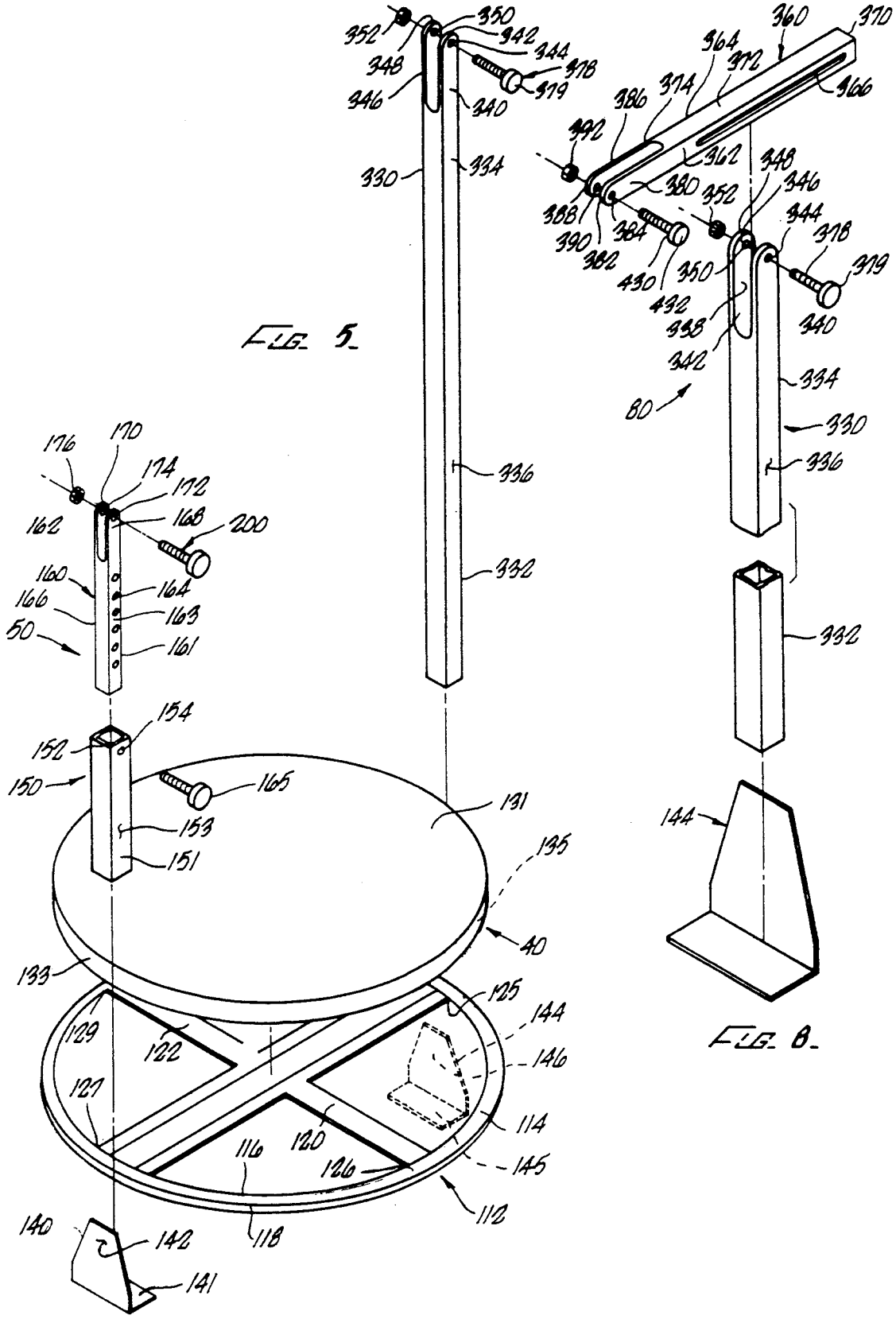
FIG. 5 is an exploded perspective view of a base, a base cover, first and second stanchion brackets, a fixed member of a lower stanchion, a slidable member of the lower stanchion, and a fixed member of an upper stanchion, of the FIG. 1 embodiment.
FIG. 8 is an exploded perspective view of the FIG. 5 second stanchion bracket and fixed member of the upper stanchion, and an elongated slidable, pivotable member.

Referring to FIG. 5, the base sub-assembly 40 includes a circular platform frame 112 having a circumferential member 114 with an inner surface 116 and an outer surface 118. First and second "T"-shaped brace members 120 and 122, having, respectively, a first, second, and third end 124, 125, 126, and 127, 128, 129, are rigidly attached at the ends 124, 125, 126 and 127, 128, 129, to the inner surface 116 of the circumferential member 114. In the preferred embodiment, the circumferential member is formed from a one-inch diameter round tube. Circumferential member 114 is about 42 inches in diameter. A generally Circular platform cover 131 has a downwardly extending outer edge 133 forming an annular lip 135. The lip 135 snaps over or is otherwise closely received by the circumferential member 114.

As further shown in FIG. 5, a generally vertical first stanchion bracket 140 having a lower portion 141 and an upper portion 142 is rigidly attached at the lower portion 141 to the circumferential member 114. A generally vertical second stanchion bracket 144 having a lower portion 145 and an upper portion 146 is rigidly attached to the circumferential member 114 at a position diametrically opposite to the position of attachment of the bracket 140.

The base sub-assembly may be of other configurations and dimensions, so long as it performs the function of providing a stable base for the stanchion sub-assemblies. In some applications, the ground itself, or a floor, may function as the base.

C. First Stanchion Sub-Assembly

Figures 6, 7, 11:
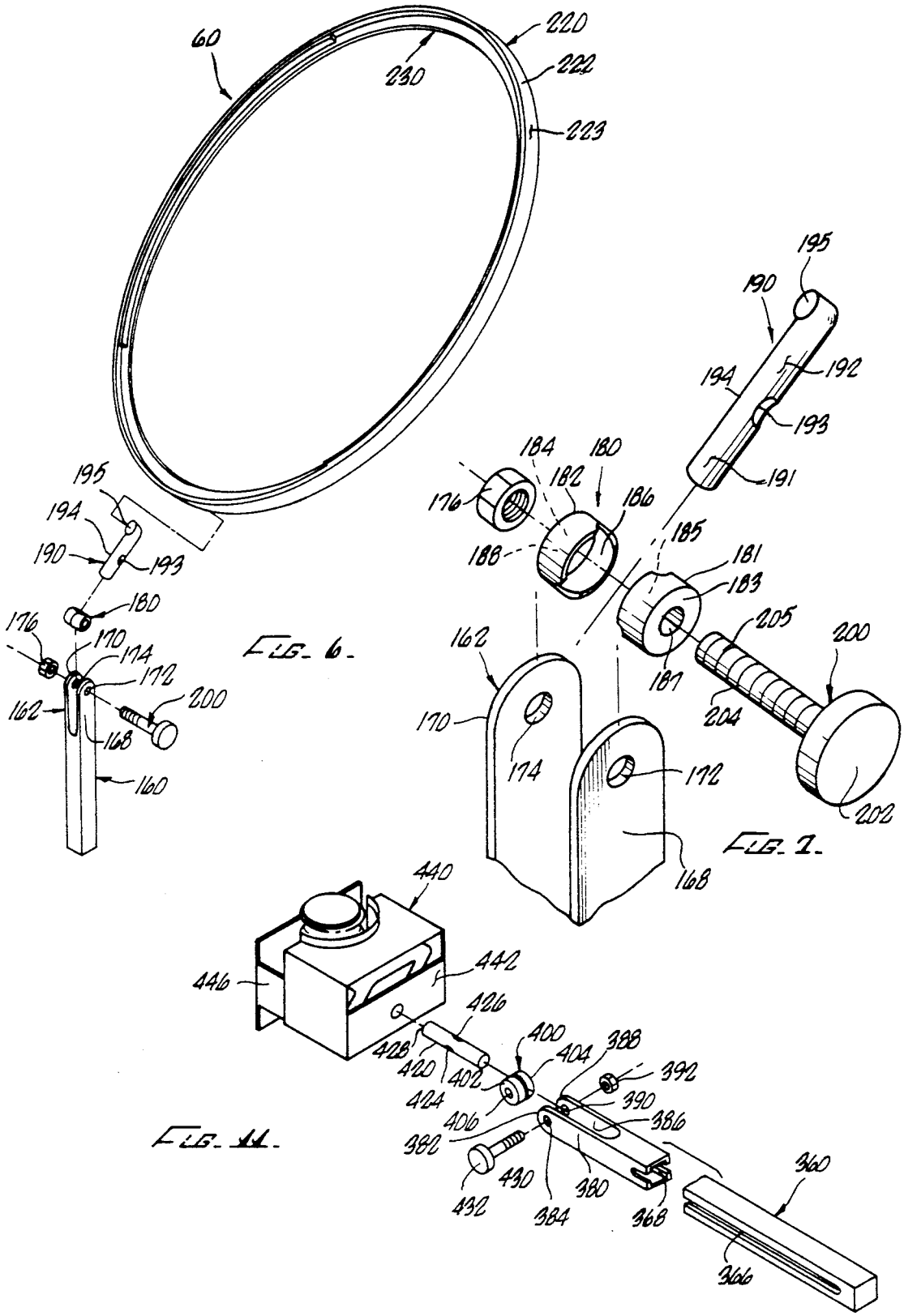
FIG. 6 is an exploded perspective view of the FIG. 5 slidable member, a lower axle, a lower clamp, a locking bolt, and a ring-shaped angle member of a ring sub-assembly.
FIG. 7 is an exploded perspective view of the FIG. 5 slidable member and the FIG. 6 lower axle, lower clamp, and locking bolt.
FIG. 11 is an exploded perspective view of the FIG. 8 elongated member, the FIG. 10 housing, upper axle and upper clamp, and a locking bolt.

As shown in FIGS. 5, 6 and 7, the first, or lower stanchion sub-assembly 50 includes a first support member 150 having a lower portion 151, an upper portion 152, and a generally vertical side 153, the lower portion 151 rigidly attached to the first stanchion bracket 140, and the side 153 including a hole 154. As shown in FIG. 5, the lower stanchion sub-assembly 50 further includes a second tubular member 160 having a lower portion 161, a slotted upper portion 162, and a generally vertical side 163. The side 163 has a plurality of evenly spaced holes 164. The member 160 is closely received by and slidably disposed within the member 150, the side 153 parallel to the side 163. As discussed in Section III, infra, when adjusting the height of the device 30 to conform to a user's physiological characteristics, the member 160 is positioned within the member 150 so that the hole 154 coincides with one of the holes 164. A locking pin 165 inserted through the holes 154 and 164 rigidly maintains the relative position of the members 150 and 160. In this way, the vertical position of a point on the ring sub-assembly is fixed.

Alternatively, and not shown in the Figures, the side 163 and a parallel side 166 of the member 160 may include generally vertical, parallel first and second slots. The position of the member 160 within the member 150 is maintained by tightening a locking bolt passing through the hole 154 and the first and second slots.

Referring to FIGS. 5 and 7, the upper portion 162 of the second tubular member 160 includes parallel, resilient first and second projections 168 and 170, the projection 168 extending upwardly from the side 163, and including a hole 172. The projection 170 includes a hole 174 and a threaded receptacle or nut 176.

Figure 17:
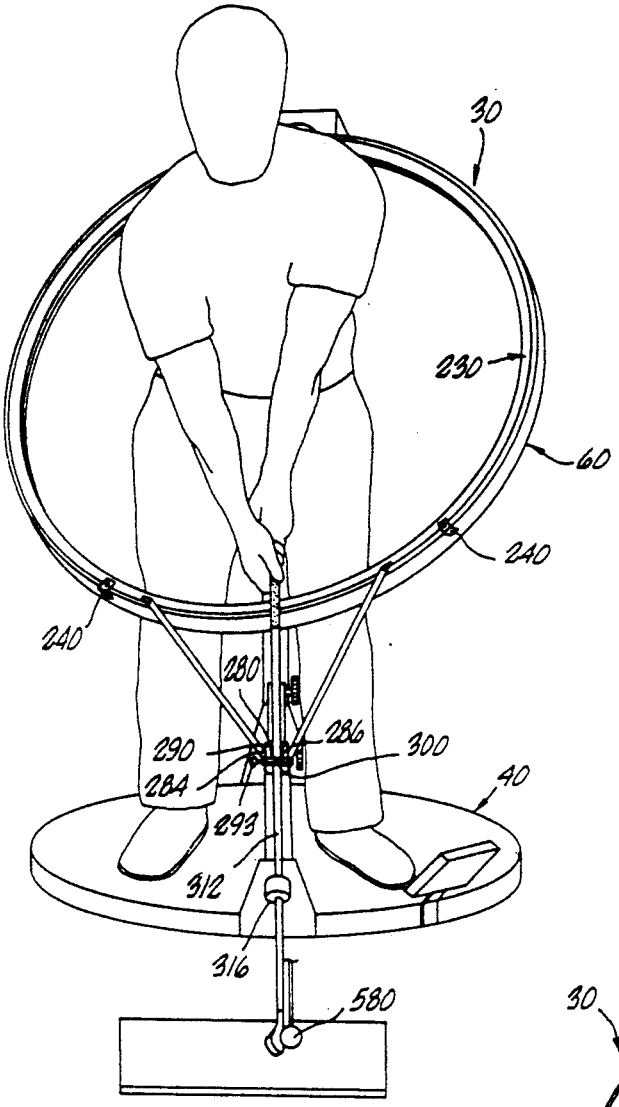
FIG. 17 shows a side elevational view of the FIG. 1 embodiment, superimposed with a perspective view of the ring sub-assembly rotated about an axis determined by the FIG. 7 lower axle and the FIG. 10 upper axle.

As best shown in FIG. 7, a bifurcated first (or lower) clamp 180 includes first and second sections 181 and 182, each having, respectively, a planar, generally circular, outer surface 183 and 184, and a cutaway, or recess shown as a concave inner surface 185 and 186. The surfaces 185 and 186 having a radius of curvature approximately equal to the convex radius of curvature of a first (or lower) axle 190 and, when assembled, provide a bore in which the axle 90 may be positioned. The surfaces 183 and 184 have, respectively, a centered hole 187 and 188 therethrough. The lower hollow axle 190 includes a lower portion 191, a middle portion 192 having a bore which terminates at first and second transversely elongated, diametrically opposite holes 193 and 194, and a truncated upper end 195. End 195 faces in a direction orthogonal to longitudinal axis of the middle portion 192. Middle portion 192 is disposed, after assembly, between and within the bore formed by clamp sections 181 and 182. The lower clamp sections 181 and 182 and the lower axle 190 are positioned between the projections 168 and 170 so that the holes 172, 187, 193, 194, 188 and 174 are aligned. The axle 190 is rigidly maintained within the clamp sections 181 and 182 by inserting a locking bolt 200 having a knob 202 and a shaft 204 With threads 205 through the holes 172, 187, 193, 194, 188 and 174, until the threads 205 are engaged within the threaded receptacle 176. Clockwise rotation of the knob 202 causes transverse compression of the resilient projections 168 and 170, thereby transversely compressing the lower clamp sections 181 and 182 around the lower axle 190. Counterclockwise rotation of the knob 202 from the tightened position enables the axle 190 to be rotated axially relative to the clamp sections 181 and 182, to an extent permitted by the width of the bore which terminates at holes 193 and 194, and also enables the lower clamp 180 to be pivoted or rotated about an axle formed by shaft 204 and relative to the projections 168 and 170. In this way, the azimuth of the ring sub-assembly and/or the rotation of the ring sub-assembly about an axis which is the longitudinal centerline of axle 190. The azimuth angle, $\Psi$, is shown in FIG. 17.

In the preferred embodiment, the member 150 is fabricated from square cross-section metal tubing having inner dimensions of 2 inches×2 inches, and is about 12 inches in length. The member 160 is fabricated from square cross-section metal tubing having outer dimensions of 1¾ inches×1¾ inches, and is about 12 inches in length. The lower axle 190 is preferably a one-inch diameter steel tube, and is about 4⅛ inches in length.

The first stanchion sub-assembly may be of virtually any of many various designs, heights and/or dimensions, so long as it functions to enable the user to (a) adjust the vertical position of one point on the ring sub-assembly; (b) adjust, preferably in combination with the second stanchion sub-assembly, the angle of rotation, or azimuth angle, of the ring sub-assembly about an axis which is a line between the points of connection of the ring sub-assembly to the first and stanchion sub-assemblies, respectively; and (c) adjust, preferably in combination with the second stanchion sub-assembly, the angle of elevation of the ring subassembly.

D. Stationary And Rotatable Ring Sub-Assembly

Figure 9:
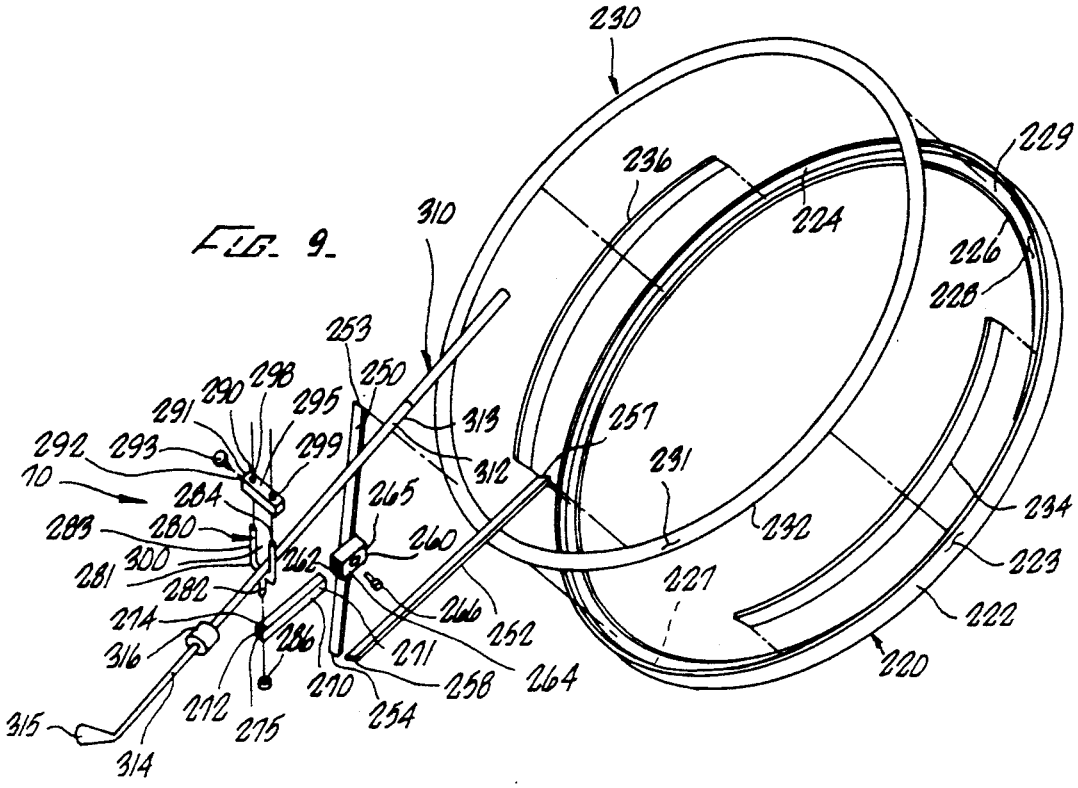
FIG. 9 is an exploded perspective view of the FIG. 6 angle member and a rotatable tubular member of the ring sub-assembly, a club-holder sub-assembly including first and second frame members, a housing, a shaft including a swivel connector, a U-shaped member, a slidable cross-piece and a shaft stop member, and a golf club.
Figure 10:
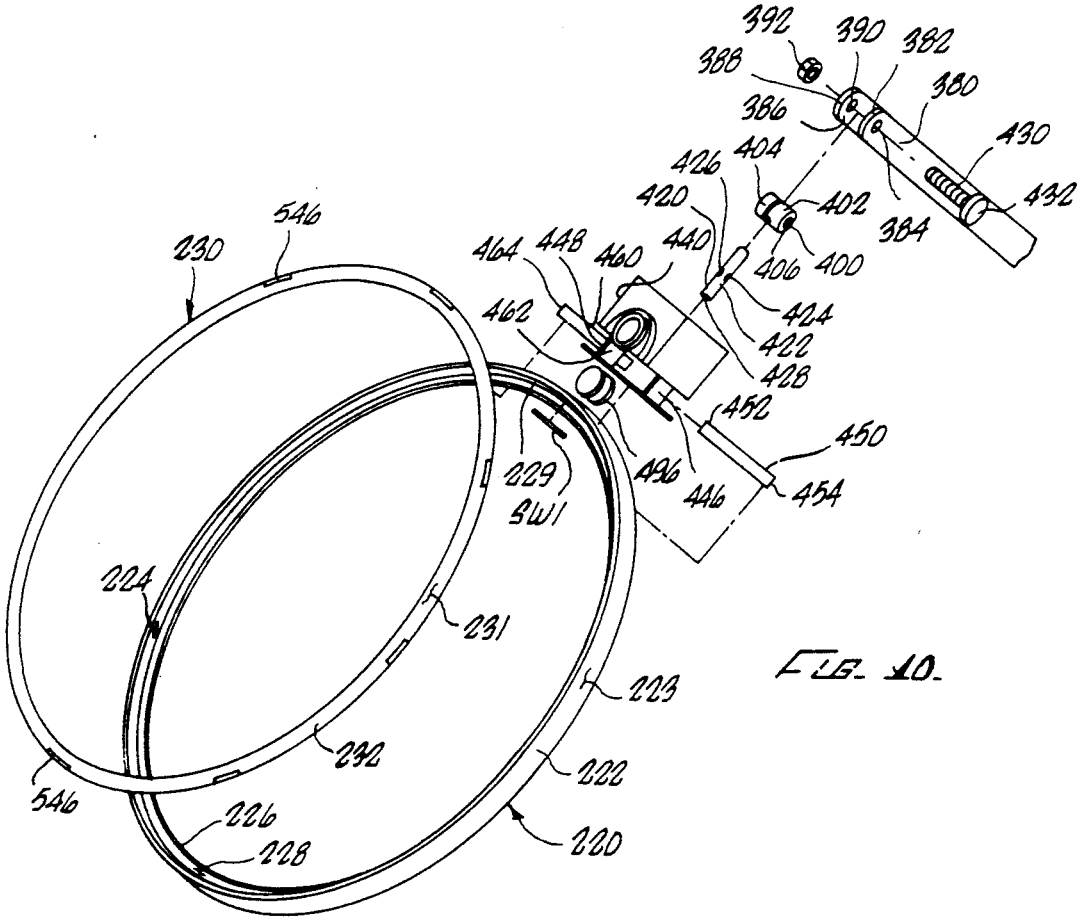
FIG. 10 is an exploded perspective view of the FIG. 6 angle member, the FIG. 9 rotatable member, the proximal portion of the FIG. 8 elongated member, an upper clamp, an upper axle, a box-shaped housing, first and second mounting brackets, a clutch, a governor wheel, and a magnetic switch.
Figure 18:
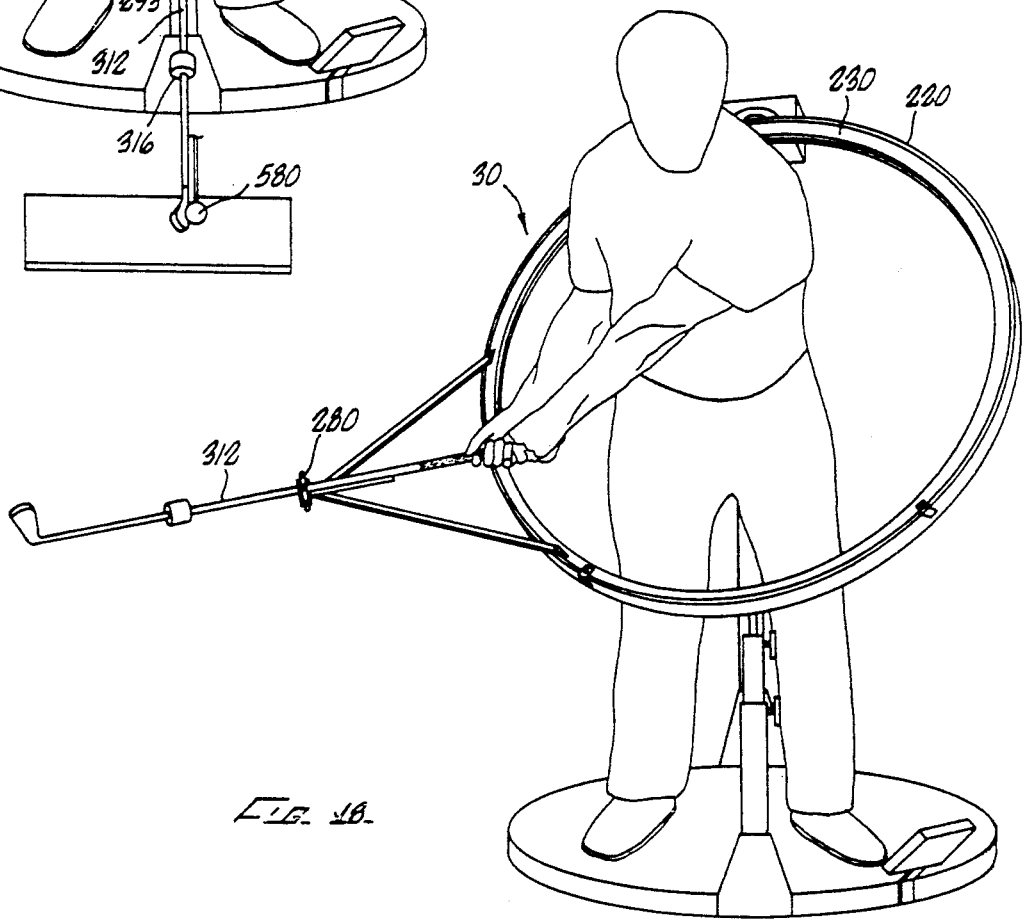
FIG. 18 is a perspective view of the FIG. 1 embodiment where a person in the set-up phase of a full-range of motion golf swing is constrained to swing a club within a predetermined swing plane.

Referring to FIGS. 6, 9 and 10, the stationary and rotatable ring sub-assembly 60 includes a generally circular angle member or stationary ring 220 having a first flange 222 with an exterior surface 223 and an interior surface 224, and a second flange 226, orthogonal to the flange 222, with an exterior surface 227 and an interior surface 228, the interior surfaces 224 and 228 forming an annular recess 229. A circular cross-section, tubular member or rotatable ring 230 having an exterior surface 231 and an outer edge surface 232 is closely received within the recess 229. In the absence of an external frictional force, the rotatable ring 230 is freely rotatable within the recess 229 of stationary ring 220. As shown in FIG. 9, rotation of the ring or member 230 is facilitated by first and second curved strips 234 and 236, fabricated from a material with a low coefficient of kinetic friction such as teflon, the strips 234 and 236 being rigidly attached to the interior surface 224 and interposed between the surfaces 224 and 232. Additionally, a plurality of teflon buttons 237A, B, C and D are rigidly attached to the top surface of flange 226 to provide a sliding surface on flange 226 for the ring 230. Preferably a minimum of eight buttons, spaced radially equidistant are used, four of which are shown in FIG. 9. Alternatively, other means of facilitating rotation of the ring or member 230, such as a plurality of roller bearings, may be disposed between the surfaces 224 and 232. As shown in FIG. 18, the rotatable ring 230 is movably retained within the recess 229 by a plurality of retainer clips 240.

Referring to FIG. 6 upper end 195 of the lower axle 190 is rigidly attached to the exterior surface 227 of the flange 226, thus constraining the stationary ring 220 within the device 30 for a given setting of the lower stanchion sub-assembly 50.

In the preferred embodiment, the stationary ring 220 is fabricated from metal or plastic, and has an outer diameter of about 43 inches. The width of the flange 222 is about 1¼ inches, and the width of the flange 226 is about 1-1/16 inches. The rotatable ring 230 is fabricated from ⅞-inch circular metal tubing, and has an inner diameter of about 41 inches. The strips 234 and 236 are each about 48 inches in length.

The stationary and rotatable ring sub-assembly may be of virtually any design, structure and dimension so long as it functions (a) to enable one point on the structure to rotate within a plane and through a full range of swing motion; (b) to accommodate various vertical and angular orientations of the plane; and/or (c) to accommodate instrumentation for measuring the speed and/or force of the swing motion.

E. Club-Holder Sub-Assembly

Referring to FIG. 9, the club-holder sub-assembly 70 includes first and second lath-shaped frame members 250 and 252. Frame member 250 has a first (or proximal) end 253 and a second (or distal) end 254. Frame member 252 has a first (or proximal) end 257 and a second (or distal) end 258. The proximal ends 253 and 257 are symmetrically disposed and rigidly connected to the exterior surface 231 of the rotatable tubular member 230. The distal ends 254 and 258 are rigidly connected to a housing 260 having a longitudinal bore 262 therethrough. Housing 260 includes a longitudinal side 264 with a hole 265 wherein is disposed a first set-screw 266.

The housing 260 is the apex of a triangle whose legs are the frame members 250 and 252, and whose base is an imaginary chord between the proximal ends 253 and 257. The plane in which the frame members 250 and 252 are disposed is offset from the plane in which the ring sub-assembly 60 is disposed. In the preferred embodiment, the offset angle is about 20°, as illustrated by angle $\phi$ in FIG. 2.

A shaft 270 having a first (or proximal) end 271, a second (or distal) end 272, and a predetermined length is slidably disposed within the bore 262. The position of the shaft 270 within the housing 260 is fixed by tightening the set-screw 266. Disposed within the shaft 270 near the end 272 is a swivel connector 274 having a bore 275. A two-tined fork, or "U"-shaped member 280 including a base 281, a threaded base projection 282, and first and second legs or tines 283 and 284, is disposed orthogonal to the shaft 270, the projection 282 received within the bore 275 and maintained in a fixed position relative to the shaft 270 by a threaded nut 286. A cross-piece member 290 including a first end 291 with a longitudinal bore 292 in which is disposed a second set-screw 293, and further including first and second parallel surfaces 295 and 296 having first and second bores 298 and 299 therethrough, is transverse to and, through the holes 298 and 299, slidably disposed along the legs or tines 283 and 284 of the U-shaped member 280. The legs 283 and 284, the base 281, and the cross-piece member 290 thus determine a bounded planar opening 300.

When the device 30 is in use, a golf club 310 having a shaft 312 including an upper portion 313, a lower portion 314, and a club head 315 transects the opening 300. The area of the opening 300 is several times larger than the cross-sectional area of the shaft 312, enabling the shaft to freely move longitudinally and axially. A stop member 316 is positioned on the lower shaft portion 314 between the club head 315 and the opening 300. The stop member 316 is dimensioned to be larger than the opening 300, so that longitudinal upward motion of the club 310 within the opening 300 is limited by the stop member 316. The position along the shaft 312 of the stop member 316 is set according to the club position at the posting phase. The stop 316 is positioned to touch the device at opening 300, and function so that during downswing a pulling motion is required by the user. As shown in FIG. 9, stop member 316 is a right circular cylinder having a central bore sized to accommodate lower portion 314 of the club 310. Stop member 316 may be formed in numerous shapes and with numerous materials, so long as it performs the functions described above. Stop member 316 may be formed of an elastomeric, foam material so that it may be slipped over the club head or handle and positioned on the shaft, or may be of rigid material, so long as it may be positioned along the shaft and function as described.

In the preferred embodiment, the frame members 250 and 252 are each about 20 inches in length, the housing 260 is about 1⅝ inches in length, the shaft 270 is about 7 inches in length and has cross-sectional dimensions of ½-inch×5/16-inch, the U-shaped member 280 is about 3½ inches in length and 1⅜ inches in width, and the cross-piece member 290 is about 1⅝ inches in length.

The clubholder sub-assembly may be of virtually any design so long as it functions to provide a rest point for the club shaft to contact during each of the phases of the swing, with the rest point traveling in or parallel to the swing plane as the swing is executed and for initiation of a pulling motion on the downswing.

F. Upper Stanchion Sub-Assembly

Referring to FIGS. 5, 8, 10 and 11, the upper stanchion sub-assembly 80 includes a tubular member 330 having a lower portion 332, an upper portion 334, and first and second parallel sides 336 and 338. The portion 332 is rigidly attached to the second stanchion bracket 144. The sides 336 and 338 extend upwardly, respectively, in a first projection 340 having an upper end 342 and including a bore 344, and a second projection 346 having an upper end 348 and including a bore 350 and a receptacle or nut 352 adapted to receive a first threaded, locking bolt 378.

As shown in FIG. 8, an elongated member or arm 360 includes parallel first and second sides 362 and 364 having, respectively, parallel first and second longitudinal slots 366 and 368. The member 360 further includes a distal end 370, a middle portion 372, and a proximal portion 374. The middle portion 372 is transversely disposed between the projections 340 and 346 so that the slots 366 and 368 are aligned with the bores 344 and 350. First locking bolt 378, having a knob 379, passing successively through bore 344, slot 366, slot 368, and bore 350 is secured by nut 352. Counterclockwise rotation of the knob 379 enables translational movement and/or pivoting movement of the member 360 with respect to the locking bolt 378. Clockwise rotation of the knob 372 enables fixing the position of the member 360 relative to the upper stanchion member 330. In this manner, the arm 360 may be rigidly maintained in a desired position and its position may be adjusted, in cooperation with the lower stanchion sub-assembly, to accommodate different vertical positions, elevation angles and azimuth angles of the ring sub-assembly.

As also shown in FIG. 8, the side 362 extends proximally in a first projection 380 having an end 382 and including a bore 384, and the side 364 extends in a second projection 386 having an end 388 and including a bore 390 and a threaded receptacle or nut 392 adapted to receive a second threaded bolt 430.

As shown in FIGS. 10 and 11, a bifurcated second (or upper) clamp barrel 400, including first and second sections 402 and 404 having, respectively, bores 406 and 408, is disposed between the projections 380 and 386. The configuration and dimensions of the sections 402 and 404 are identical to those of the lower clamp sections 181 and 182. A second (or upper) axle 420 including a middle portion 422 having a transverse bore terminated at first and second enlarged, diametrically opposite holes 424 and 426, and a lower end 428 is disposed in the bore formed between and by the cutaway portions of the clamp sections 402 and 404. The upper clamp sections 402 and 404 and the upper axle 420 are positioned between the projections 380 and 386 so that the bores and holes 384, 406, 424, 426, 408 and 390 are aligned. The axle 420 is rigidly maintained within the clamp sections 402 and 404 by a second threaded locking bolt 430 having a knob 432, the bolt 430 passing successively through the bores and holes 384, 406, 424, 426, 408 and 390 until engaged within the nut or receptacle 392. Clockwise rotation of the knob 432 causes transverse compression of the resilient projections 380 and 386, thereby transversely compressing the upper clamp sections 402 and 404 around the upper axle 420. Counterclockwise rotation of the knob 432 from its tightened position loosens the sub-assembly and enables the axle 420 to be rotated about its longitudinal axis as well axially relative to the clamp sections 402 and 404, to an extent permitted by the diameter of the oversize bore and holes 424 and 426, and also enables the upper clamp 400 to be rotated about an axis which is in the centerline of bolt 430 when inserted through bores 384 and 390 of projections 380 and 386. In this way, the azimuth of the ring sub-assembly may be fine-tuned, and, in cooperation with the first stanchion sub-assembly the degree of rotation of the ring sub-assembly about an axis which passes through the longitudinal centerline of upper axle 420 may be adjusted.

Referring again to FIGS. 10 and 11, a rectangular box-shaped housing 440 includes a top side 442, and first and second extension members 446 and 448 generally vertical to the side 442. A first mounting bracket 450 is rigidly attached at a first end 452 to the member 446, and at a second end 454 to the surface 227 of the flange 226 of the angle member 220. A second mounting bracket 460 is rigidly attached at a first end 462 to the member 448, and at a second end 464 to the surface 227. The lower end 428 of the upper axle 420 is rigidly attached to the side 442, the centerlines of axles 190 and 420 disposed along a plane intersecting a diameter of the angle member 220.

In the preferred embodiment, the stanchion member 330 is about 55" in length, and has cross-sectional dimensions of 2¼"×2¼." The arm member 360 is about 29" in length, and has cross-sectional dimensions of 1¾"×1¾". The slots 366 and 388 are each about 20" in length and 7/16" in width. The upper axle 420 is 1" in diameter and about 4" in length. The housing 440 has dimensions approximately 8" in length×4" in width×6" in height.

The second stanchion sub-assembly may be of virtually any design so long as it provides, preferably, a point of contact and support for the ring sub-assembly which is on the opposite end of the diameter extending to the point of contact with the first stanchion sub-assembly. The second stanchion sub-assembly also, preferably, provides structure which, in cooperation with the first stanchion sub-assembly, permits the azimuth of the ring sub-assembly to be adjusted by rotating the ring sub-assembly about a diameter between the two connection points. The second stanchion sub-assembly also functions, preferably, to provide a support for the clutch or resistance sub-assembly to contact the rotatable portion of the ring sub-assembly. The second stanchion sub-assembly also functions, preferably in conjunction with the first stanchion sub-assembly, to permit adjustment of the angle elevations of the ring sub-assembly.

G. Hydraulic Resistance Sub-Assembly

Figure 12:
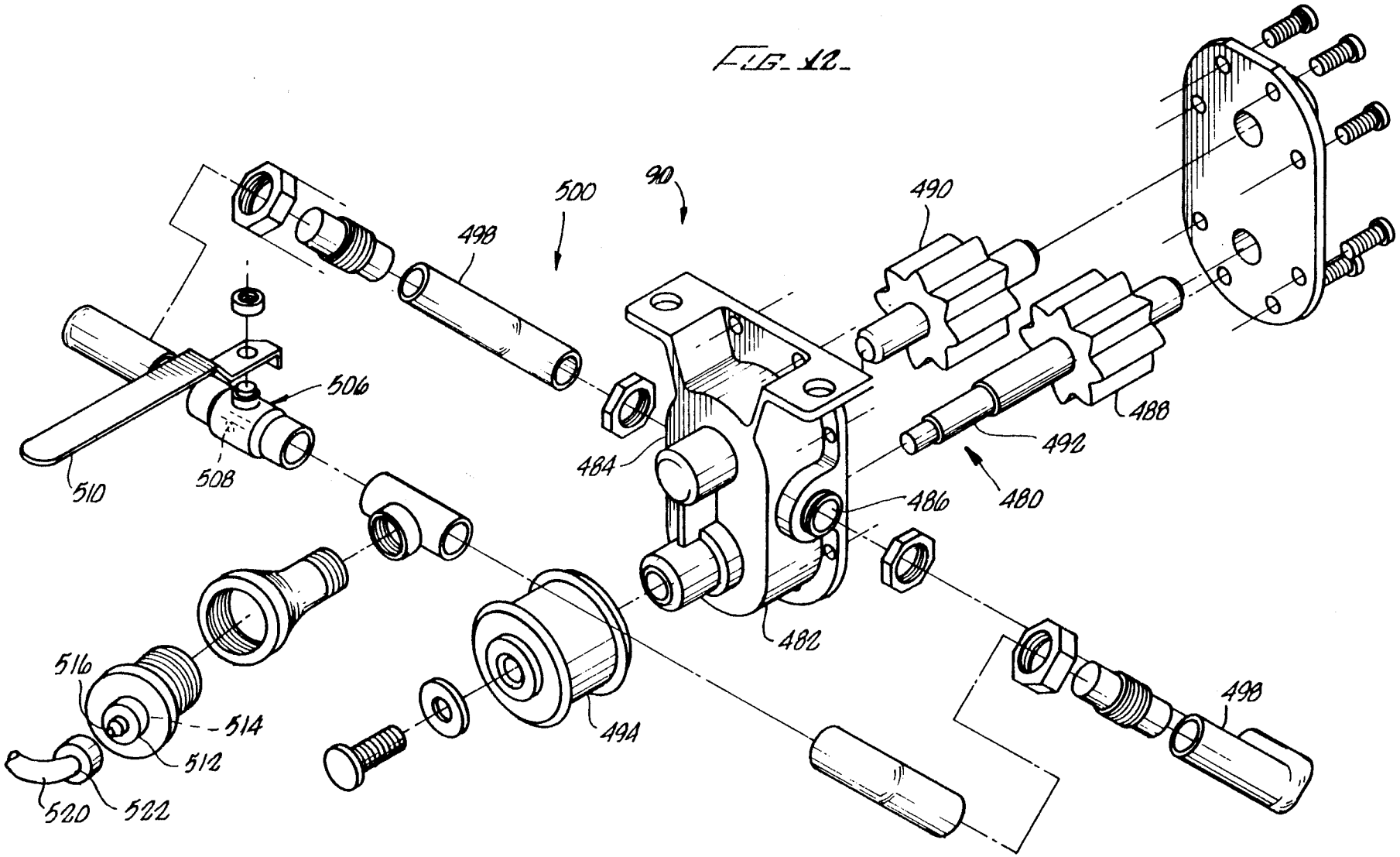
FIG. 12 is an exploded perspective view of a hydraulic gear pump, a drive shaft, the FIG. 10 clutch, a flow restricting valve, a needle valve, a rigid hydraulic fluid conduit, and a flexible hydraulic fluid conduit.
Figure 13:
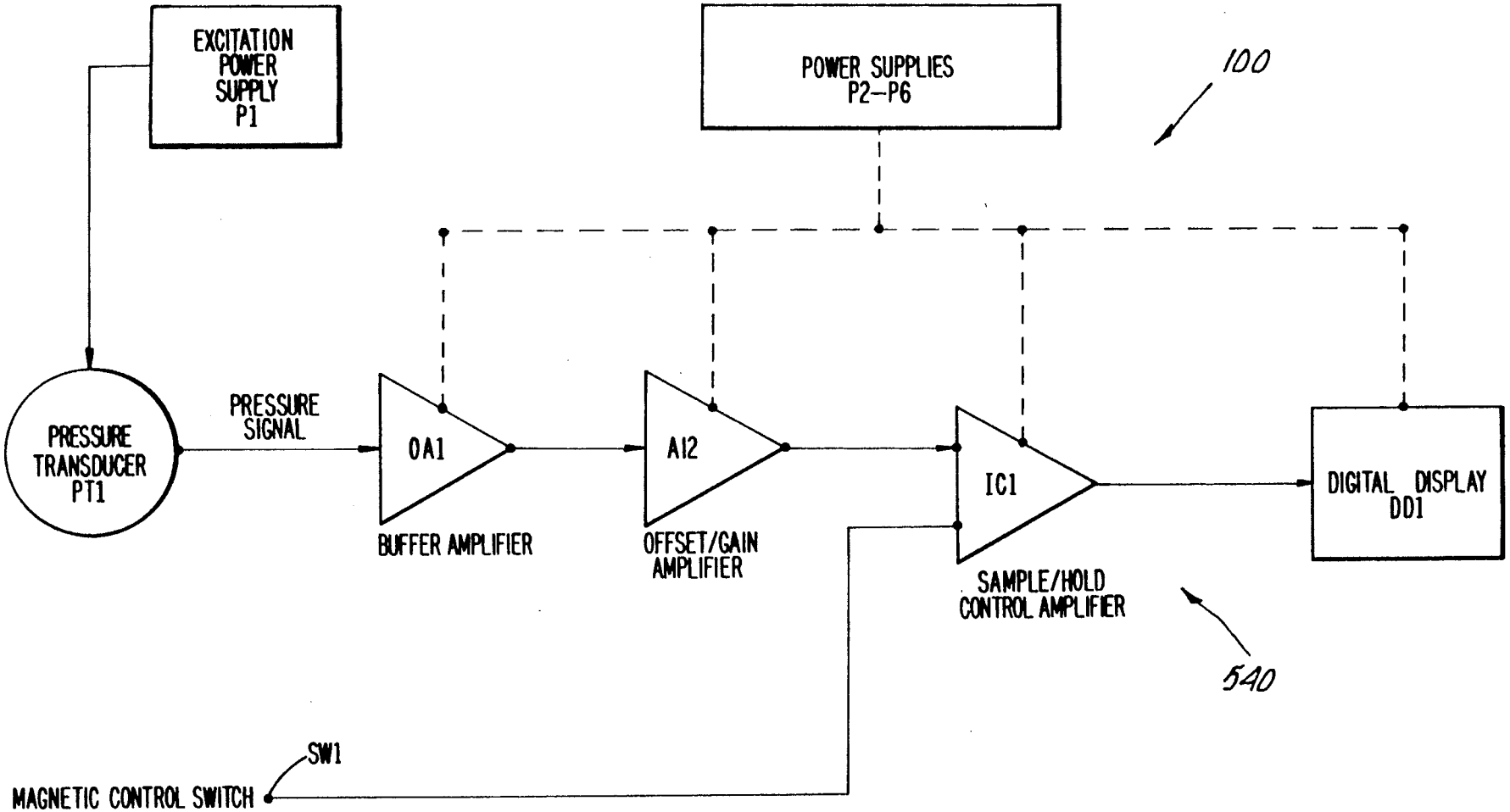
FIG. 13 is a block diagram of an electronic monitoring sub-assembly of the FIG. 1 embodiment.

Shown in FIG. 12 is an exploded perspective view of the hydraulic resistance, or clutch, sub-assembly 90, some of the components of which will be discussed below as they relate to the present invention. The sub-assembly 90 includes: a hydraulic gear rotary pump 480 mounted within the housing 440 (not shown in FIG. 12). Pump 480 has a pump housing 482, an outlet port 484, an inlet port 486, a drive-gear 488, and an idler-gear 490. A drive-shaft 492 is rigidly connected to the drive-gear 488 and extends in a generally perpendicular direction from the pump housing 482. A one-way clutch 494 is rotatably connected to the drive-shaft 492 with conventional one-way needle bearings (not shown). A friction-type governor wheel 496, best shown in FIG. 10, is mounted on the housing 440. Alternately, a sprocketed, one-way clutch could be used, in which case no governor would be needed, and ring 230 would have meshing gear teeth. Conduit 498 fluidly connects the discharge, or outlet port 484 and the inlet port 486, so as to constitute a closed fluid circuit, or flow system 500. A conventional flow restricting valve 506, having a conventional, adjustable aperture 508 is positioned in the circuit downstream of discharge 484 and upstream of connector 512. The degree of opening of aperture 508 is adjusted by a lever arm 510. Connector 512 has an inlet 514 and an Outlet 516. Flexible conduit 520 is filled with hydraulic fluid during operation and has a first end 522 and a second end 524 (shown in FIG. 13). End 522 is connected to the outlet 516 of the needle valve 512, and end 524 is connected to a pressure transducer PT1, as illustrated in FIG. 13.

In the preferred embodiment, the gear pump 480 is model number AJN, manufactured by Sterling Pump, Ltd. of Mississauga, Canada. The drive-shaft 492 extends about $1\frac{3}{8}$" outside of the pump housing 482. The clutch 494 is about $3\frac{1}{4}$" in diameter. The flow restricting valve 506 is a conventional ball valve. The pressure transducer PT1 is a piezoresistive strain gauge, part number MPX200DP, manufactured by Motorola Corporation.

Numerous pump designs may be adapted for use with the present invention so long as the pump will provide an isokinetic resistance. Preferably, a positive displacement pump is used because such pumps operate to approximate totally isokinetic resistance.

The rotatable tubular member, or ring, 230 is pinched between the clutch 494 and the governor wheel 496. As the user applies force to the golf club during the downswing, the resultant rotating of the ring 230, which is in frictional contact with the clutch 494, causes the clutch and thus the drive-shaft 492 to rotate. Rotation of the drive-shaft 492 causes the drive-gear 488 of the gear pump 480 to rotate at the same angular speed as the drive-shaft. Rotation of the drive-gear 488 causes the idler-gear 490, which is meshed with the drive-gear 488, to also rotate, resulting in pumping of hydraulic fluid between the gears 488 and 490, from the inlet side 486 of the chamber inside of the pump 480 to the discharge side 484.

The rate of flow of hydraulic fluid which can circulate in the closed system 500 is limited by the aperture 508 of the flow restricting valve 506 to control maximum speed of the ring. Predetermined set points can then be established on the valve so that different maximum speeds, to accommodate the needs of different swings can be established. Thus, resistance to the rotation of the ring through swinging of the club can be adjusted by controlling the opening of valve 506. In this way, true isokinetic exercise during the swing may be achieved, with the initial or base resistance determined by the degree of opening of the aperture 508. The initial valve setting is selected according to the training velocity desired by the user. Thus, the swing training device of the present invention may be used to improve the power of a swing, and thereby the distance the ball travels. The force component of power training is dominant when using valve settings which are relatively closed. The velocity component of power may be trained by using valve settings which are relatively open.

Because the maximum speed is set by setting the valve aperture 508, the pressure in the hydraulic system will be proportional to the force applied during the swing. transducer PT1 generates an electrical signal proportional to pressure. Thus, information concerning the force applied by the user can be measured, displayed and used for further training. Thus, measurement of the pressure instantaneously imposed on Transducer PT1 at selected positions along the downswing arc, or electrical signals corresponding to those pressures, provides information at various phases of the swing. This feedback information may then be used to improve the swing by comparing the profile of the measured values with an optimum profile.

The hydraulic resistance sub-assembly may incorporate various designs, so long as it functions to provide substantially isokinetic resistance to the swing initiated by the user and/or provides for sensing instantaneous hydraulic pressure in the system as a swing is executed.

H. Electronic Monitoring Sub-Assembly

Figure 14:
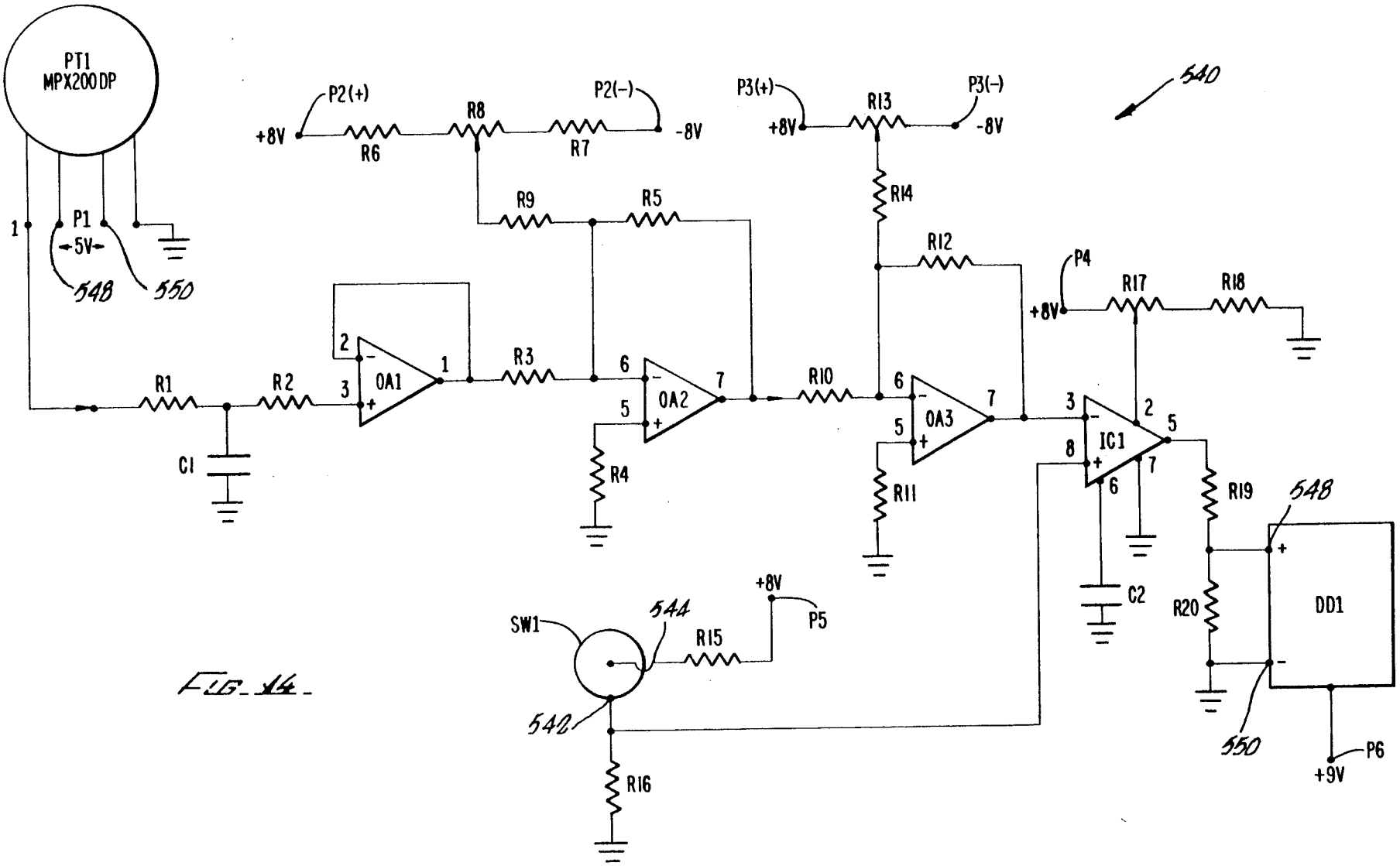
FIG. 14 is a power monitoring and readout display circuit diagram of the FIG. 13 sub-assembly.

FIG. 13 shows a block diagram for the electronic monitoring sub-assembly 100 including: a direct current (d-c) excitation power supply P1 for the pressure transducer PT1; a power monitoring and readout display electronic circuit 540 comprising a conventional buffer amplifier OA1, a two-stage offset/gain amplifier A12, and a sample/hold control amplifier IC1; a digital display meter DD1; a magnetic control switch SW1 having first and second leads 542 and 544 shown in FIG. 14; and a plurality of d-c power sources, P2, P3, P4, P5, P6, for supplying power to the electronic circuit 540, the switch SW1, and the meter DD1. As shown in FIG. 10, the magnetic control switch SW1 is attached to the interior surface 224 of the stationary ring-shaped angle member 220. As also shown in FIG. 10, a plurality of permanent bar magnets 546 are disposed at approximately equal intervals along an approximately 270 degree arc of the outer edge surface 232 of the rotatable ring 230.

In the preferred embodiment, the buffer amplifier OA1 is a conventional first operational amplifier (op-amp), part number MC4554CP, manufactured by Motorola, the offset/gain amplifier A12 comprises second and third MC4554CP op-amps, the sample/hold control amplifier IC1 is a conventional integrated circuit, part number LF398N, manufactured by National Semiconductor Corp., conventional magnetic control switch SW1 is part number 49-495, manufactured by Radio Shack, and the conventional digital display meter DD1 is a combined 200 millivolt full-scale digital voltmeter and LED display, model number DM10XL, manufactured by Beckman Instruments.

As discussed in reference to FIG. 12, a pressure change in the hydraulic fluid circulating in the closed system 500 is sensed transducer PT1. Changes in mechanical stress in the transducer due to fluctuations in ambient fluid pressure cause the transducer to generate a pulsating d-c electrical current. A resultant signal voltage, after being filtered of transient pulsation components, is fed to and amplified by buffer amplifier OA1 which isolates the transducer PT1 from the subsequent stages of the electronic circuit 540. A portion of the amplified signal is fed back with unitary gain to the input of OA1 so as to further isolate and improve the stability of the amplified signal. The amplified signal is then input to a second op-amp OA2, the first stage of the two-stage amplifier A12. The output signal from the second op-amp OA2 is input to a third op-amp OA3. In the preferred embodiment, op-amps OA2 and OA3 each use a MC4554CP chip.

The amplified signal from op-amp OA3 is fed to the amplifier IC1 which continuously monitors the signal. When the magnetic control switch SW1 disposed on the stationary ring-shaped angle member 220 is activated by sequential transit of each of the bar magnets 546 on the rotatable tubular member 230, the switch SW1 changes state from OFF to ON, and then resets to the OFF state. When the switch SW1 is transiently in the ON state, the amplifier IC1 passes the amplified signal to the meter DD1, for the particular orientation of the ring 230 relative to the stationary member 220 which corresponds to the particular magnet 546 then activating the switch SW1. The meter DD1 records the signal amplitude corresponding to the particular magnet 546 in a register and displays the amplitude graphically as a lighted LED. It is also intended that a vertical column of LEDs may be used to register and display a predetermined number of values, corresponding to the various points of measurements on the ring. Preferably, the number of vertical columns of lights equals the number of measuring points, i.e., magnets 546, so that at the completion of the swing a profile is displayed on the meter DD1. Optionally, the signal amplitude can be displayed as a numerical value by the meter DD1. Thus, as the user swings the golf club through a full-range of motion swing from the top of the swing phase through the follow-through phase, a signal amplitude profile is generated, graphically and/or numerically. The user can immediately compare his or her profile with an ideal signal amplitude profile and from this comparison gain information about how to improve the swing.

Referring to FIG. 14, the FIG. 13 circuit 540 is shown in detail. In the preferred embodiment, excitation power supply P1 is a five volt d-c source connected across first and second floating leads 548 and 550 of transducer PT1. A signal current generated by transducer PT1 is output at lead 1, which is connected to resistor R1. Resistor R1, preferably 5.6K ohms (Ω). Resistor R1 and a capacitor C1, preferably 2.2 microfarads (μfd), constitute a low-pass filter which filters out signal pulsations above about 13 Hz. The filtered current passes through a load resistor R2, preferably 1K Ω, connected to a positive input, pin 3, of inverting op-amp OA1. A portion of the amplified signal at output pin 1 is fed back with a unitary gain to negative input pin 2, of op-amp OA1, so as to isolate and stabilize the pin 1 output signal. The stabilized signal passes through a load resistor R3, preferably 10K Ω, to negative input pin 6 of op-amp OA2. A resistor R4, having the same resistance as resistor R3, is in series with positive input pin 5, of op-amp OA2, so as to approximately equalize the voltage drops produced by the input bias currents of op-amp OA2. A portion of the signal output at pin 7 of op-amp OA2 is fed back, through resistor R5, preferably 100K Ω, to pin 6. A voltage divider network including fixed resistors R6 and R7, each preferably 200K Ω, and variable resistor R8, preferably 20K Ω, is connected via load resistor R9, preferably 5.6K Ω, to pin 6. A "trim" adjustment of resistor R8 enables the output at pin 7 of op-amp OA2 to be zero when the input signal at pin 6 is zero.

The signal output at pin 7 of op-amp OA2 passes through load resistor R10, preferably 10K Ω, to a negative input of inverting op-amp OA3, the second stage of amplifier A12. The voltage drops produced by the input bias currents of op-amp OA3 are equalized by selecting resistor R11, preferably 10K Ω, to be equal in resistance to resistor R10. The amplified signal output at pin 7 of op-amp OA3 is fed back through resistor R12, preferably 20K Ω, to pin 6. An eight-volt d-c power source, P3, is connected across a potentiometer R13 which is connected to pin 6 through a resistor R14, preferably 200K Ω. A trim adjustment of resistor R13, preferably 25K Ω, enables the output at pin 7 of op-amp OA3 to be zero when the input signal at pin 6 is zero.

The signal output at pin 7 of op-amp OA3 is input to pin 3 of the control amplifier IC1. Pin 2 of amplifier IC1 is connected to a variable resistor R17, preferably 1K Ω, the resistor R17 in series between a positive eight-volt d-c power source P4, and a resistor R18, preferably 22K Ω, the resistor R18 connected to ground pin 6 of amplifier IC1 is connected via capacitor C2, preferably 0.1 μfd to ground, and pin 7 of amplifier IC1 is connected directly to ground. Pin 8 of amplifier IC1 is connected to lead 542 of magnetic switch SW1. The magnetic switch SW1 is powered by a positive eight-volt d-c power supply P5, connected to lead 544 via resistor R15, preferably 1K Ω. Lead 542 of switch SW1 is connected to ground via resistor R16, preferably 1K Ω.

The current output at pin 5 of amplifier IC1 passes through resistor R19, preferably 15K Ω to a positive terminal 548 of the meter DD1, which preferably reads 200 millivolts full-range. A load resistor R20, preferably 1K Ω, is connected between the positive terminal 548 and a negative terminal 550 of meter DD1. The meter DD1 is powered by a positive nine-volt d-c power supply P6.

III. Operation of the Rotating Ring Swing Training and Exercise Device

A. Device Adjustments To Accommodate Users Of Different Height, Different Stance, And Different Shot-Making Styles Referring to FIG. 15, when a user of the device 30 swings the club 310, thus causing rotation of the rotatable ring 230, the distal end 272 of the shaft 270 is constrained to move in a plane 560 which is parallel to a plane 565 which is the plane of the ring sub-assembly 60, and thus is parallel to the swing plane 570. Therefore, a point at the bottom of the U-shaped member 280, which is attached to the shaft 270 at 272, is constrained to move in the plane 560 because the club-holder sub-assembly 70 is rigidly offset from the plane 565 of tubular member 230. A point on the club head 315 extending from the shaft 312 ideally moves in a non-circular arc in the swing plane 570 to describe the swing path. Swing plane 570 is parallel to the planes 565 and 560 because the shaft is constrained within the opening 500 and against the U-shaped member by the golfer during the swing. The moving club head thus satisfies an essential requisite of an ideal golf swing in that the swing path is in the swing plane. It is an important feature of the present invention that its structure facilitates generation of a proper swing path in the swing plane and through a full range of motion.

When a right-handed golfer executes a full-range of motion swing, the club moves clockwise during the backswing portion of the swing with the 12 o'clock position being a point on the stationary ring adjacent the clutch 494, and counterclockwise during the downswing portion of the swing. For a left-handed golfer, the rotational directions are reversed. Consequently, a user, accordingly as he or she is a right-handed or left-handed golfer, must first select a device 30 with the resistance sub-assembly 90 configured so the clutch 494 frictionally engages the ring 230 during the downswing portion of the swing.

A user's height, arm length, and posture at address generally determine the height of his or her hands while gripping a club during the set-up phase so that the clubface squarely contacts the addressed ball. Posture is generally determined by the user's height, preferred swing plane, and length of the selected club. Consequently, initial adjustments are directed to the height and angle of inclination of the ring sub-assembly 60. Referring again to FIGS. 5 and 6, the height and angle of inclination of the ring sub-assembly 60 with respect to the base sub-assembly 40 are coarsely adjusted to generally match the user's height and preferred swing plane by sliding the first, or lower, stanchion member 160 within the lower stanchion member 150 so as to align one of the plurality of holes 164 with the hole 154 in the member 150. Concurrently, the elongated member 360 is moved linearly and/or pivoted with respect to the upper stanchion member 330 by loosening the locking pin 378 and moving the member 360 with respect to the pin 378 by means of the slots 366 and 368. Graduated markings may be provided on the lower stanchion member 160 and/or the elongated member 360 to facilitate identification of preferred settings. The initial, or gross adjusted position is rigidly maintained by inserting the pin 165 through the aligned holes 154 and 164. These initial adjustments are generally made only when a person first uses the device, or before the device is to be used by another person.

Referring again to FIGS. 2 and 15, after the initial adjustments are made, the angle of elevation $\alpha$ of the ring sub-assembly 60 may be further adjusted by loosening the locking bolts 200 (FIG. 7) and 430 (FIG. 8) which, when tightened, rigidly maintain, respectively, the axles 190 and 420 in the clamps 180 and 400. The user can then pivot the clamps 180 and 400 within the projections 168, 170 and 380, 382, respectively, so as to slightly change the angle of inclination. Graduated markings may be provided on the axles and clamps to facilitate identification of preferred individual settings. Such fine adjustment generally would be necessary if a person wished to train with golf clubs of significantly different length, e.g., a driver, a long iron, and a short iron.

When the locking bolts 200 and 430 are loosened, the ring sub-assembly 60 can be rotated about a diameter defined by the axles 190 and 420, because the axles can rotate within the clamps 180 and 400. Thus, the azimuth of the ring sub-assembly 60 can be changed relative to a target line extending from the golf ball to an imaginary target area or specific target such as a hole on a golf course. This fine adjustment is necessary when a person wishes to perfect a swing motion which slightly changes the swing path, thus resulting in fading or drawing a ball, rather than propelling the ball directly along the target line.

Figure 15:
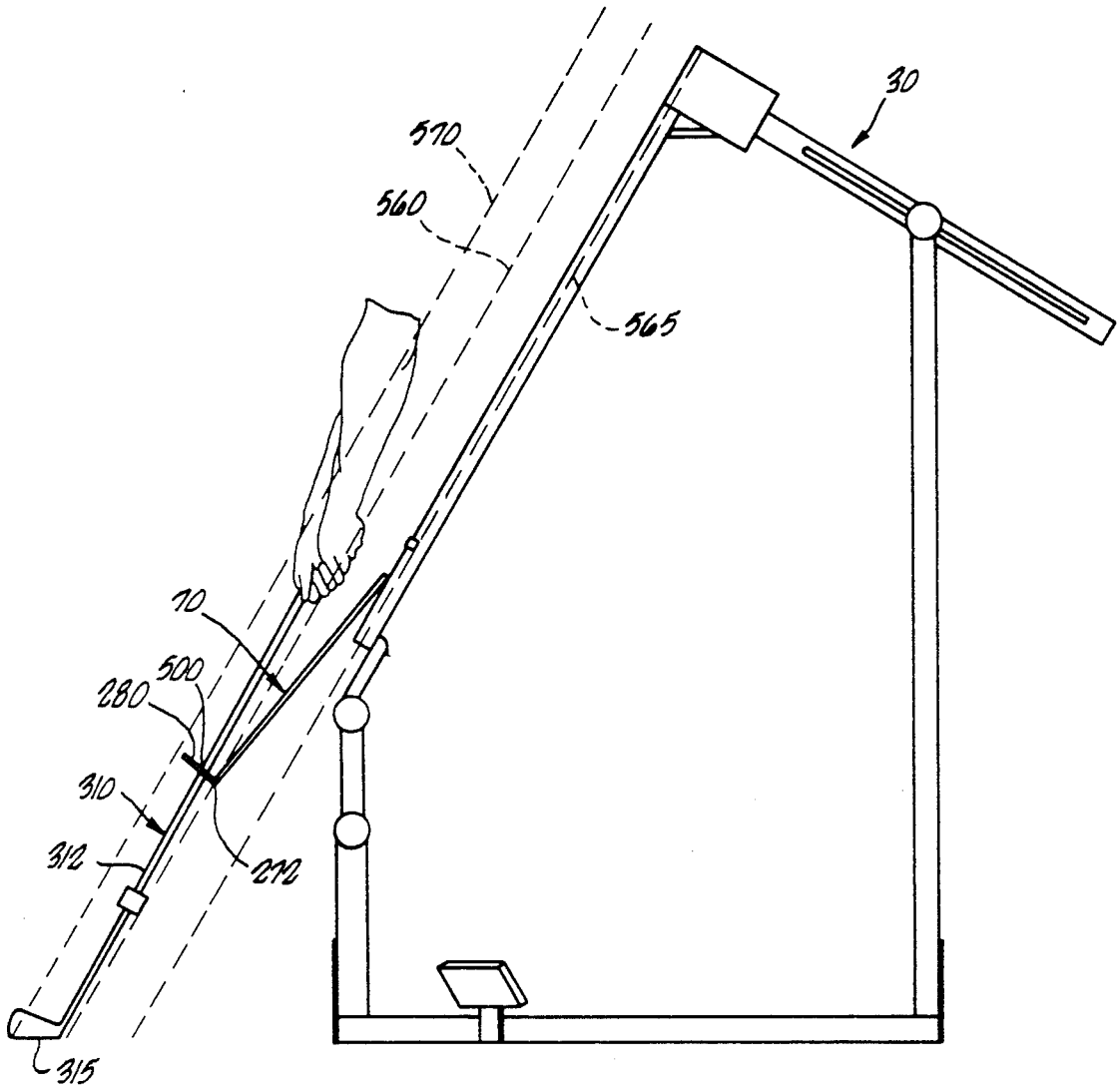
FIG. 15 shows the ring sub-assembly plane, a plane in which the distal end of the FIG. 9 shaft is constrained to move when the FIG. 9 tubular member rotates, and a plane in which the swing path of the FIG. 9 club head lies, the three planes being mutually parallel.
Figure 16:
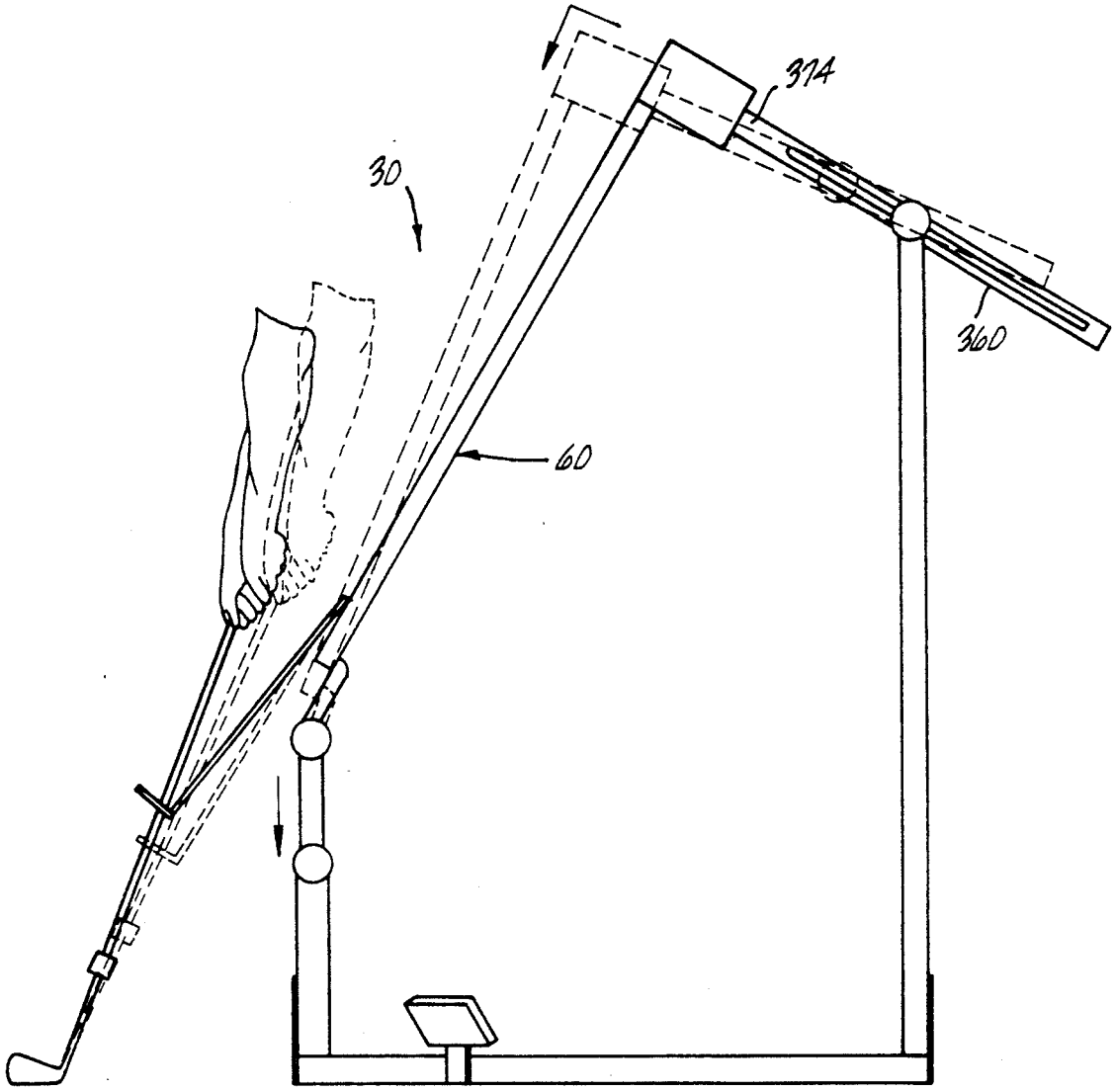
FIG. 16 is a side elevational view of the FIG. 1 embodiment, showing the disposition of the FIG. 5 slidable member, the FIG. 8 elongated member, and the FIG. 9 ring sub-assembly and club-holder assembly, for a first swing plane orientation in which the ring sub-assembly is in a relatively flat plane, and for a second orientation in which the ring sub-assembly is in a relatively upright plane.

In FIG. 16, the solid lines show the device 30 adjusted in a first orientation for a user who has a relatively flat swing plane, i.e., a relatively smaller angle $\alpha$ as shown in FIG. 15, and prefers trying to hit the ball along the target line. The proximal portion 374 of the pivotable-slidable member 360 is relatively upright, and the ring sub-assembly 60 parallels the target line.

The dotted lines in FIG. 16 show the device 30 adjusted in a second orientation for a shorter user who also prefers trying to hit the ball along the target line, and who prefers a relatively upright swing plane. Compared to the first orientation, the member 360 is pitched forward and is relatively horizontal, the member 160 is lower, and the clubholder sub-assembly 70 is lower and lies in a more nearly vertical plane.

FIG. 17 shows the ring sub-assembly 60 in a first orientation for a user who prefers to hit the ball along the target line, and in a second orientation for the same user who is trying to perfect a swing which draws the ball. In the second orientation, the ring sub-assembly 60 is slightly rotated clockwise at an azimuth angle $\Psi$ so that the club head moves in an in-to-out swing path relative to the target line during the hitting zone and impact phases.

FIG. 18 shows a right-handed user addressing a ball 580 during the set-up phase, after the height, angle of inclination, and azimuth of the ring sub-assembly have been appropriately set. First, the user positions stop member 316 over the club shaft at region 314, between mid-club and the club head 315. Then the user, while standing on the base sub-assembly 40 with his upper body centered within the ring sub-assembly 60, inserts the shaft 312 of a selected golf club through the opening 300, shown in FIG. 9, determined by the pivotable U-shaped member 280 and the slidable cross-piece member 290, and slides the member 290 on the legs 284 and 286 to reduce the area of opening, 300, but to locate the cross-piece 290 in a position where the club shaft can freely slide and rotate within the opening 300 as the club travels through a full-range of motion swing. The position of the cross-piece member 290 is maintained by tightening the set-screw 293. The user then positions the stop member 316 along the club shaft 312 so that it contacts the members 280 and 290 when the club is posted at the top of the swing and enables proper initiation of the downswing (pulling motion rather than pushing) and initiation of rotation of the ring during the downswing.

A golfer's height is generally the determining factor of his or her swing radius. In general, the taller the person, the larger the swing radius. In the device 30, the swing radius is effectively a lever arm through which the user applies force to the rotatable tubular member 230. The lever arm length is determined by the distance along the club shaft between the user's hands and the U-shaped member 280. Referring again to FIG. 9, the lever arm length and thus the swing radius is adjusted by loosening the set-screw 266 and slidably adjusting the shaft 270 within the housing 260. The shaft 270 is properly positioned within the housing 260 when the clubface contacts the ball when the user is in the address position. Graduated markings may be provided on the shaft 270 to facilitate identification of preferred individual settings.

Figure 19:
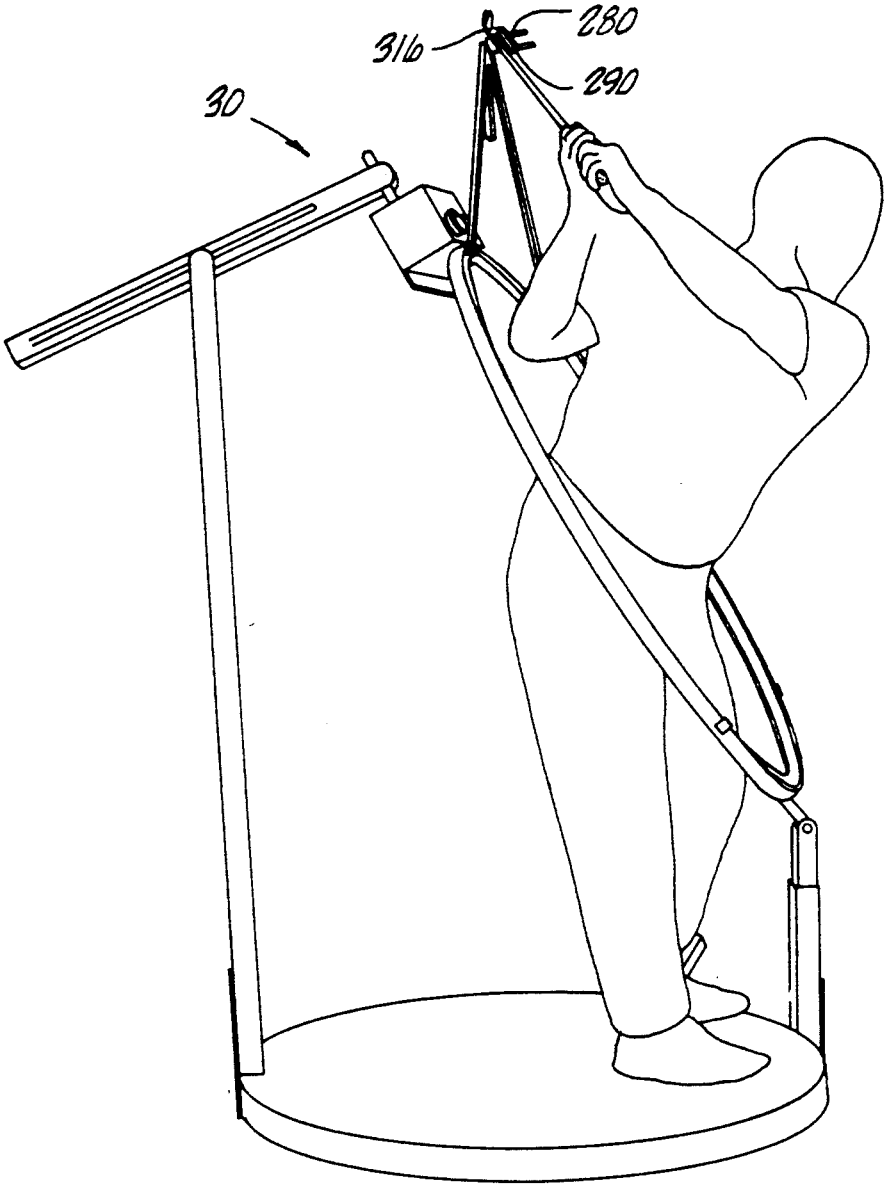
FIG. 19 is a perspective view of the takeaway phase of the full-range of motion swing.

B. General Operation Of The Device In The Context Of An Ideal Eight-Phase Golf Swing Beginning from the set-up phase shown in FIG. 18, the user initiates the takeaway phase, shown in FIG. 19, by rotating the knees, hips, trunk and shoulders as the front arm pushes the back arm back and the front elbow and front arm remain straight. As these body motions are performed, the member 230 freely rotates within the stationary angle member 220 in the backswing direction.

Figure 20:
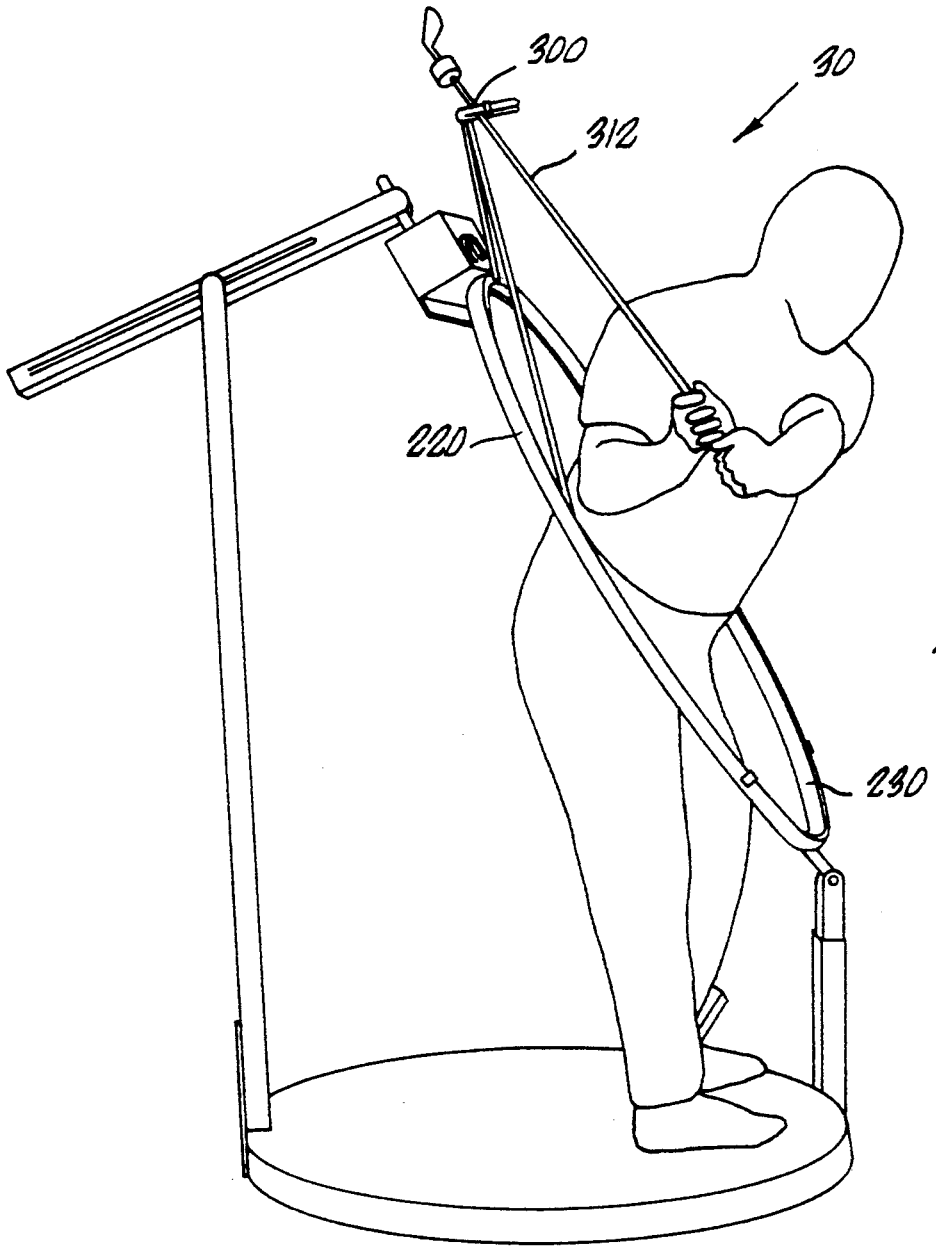
FIG. 20 is a perspective view of the top-of-the-swing phase of the full-range of motion swing.

FIG. 20 shows the top of the swing phase where the shoulders have turned about twice as far as the hips. The front arm has remained straight, the back forearm is now supinated, and the front forearm is now pronated. The stop member 316 is in contact with the U-shaped member 280 and the cross-piece member 290.

Figure 21:
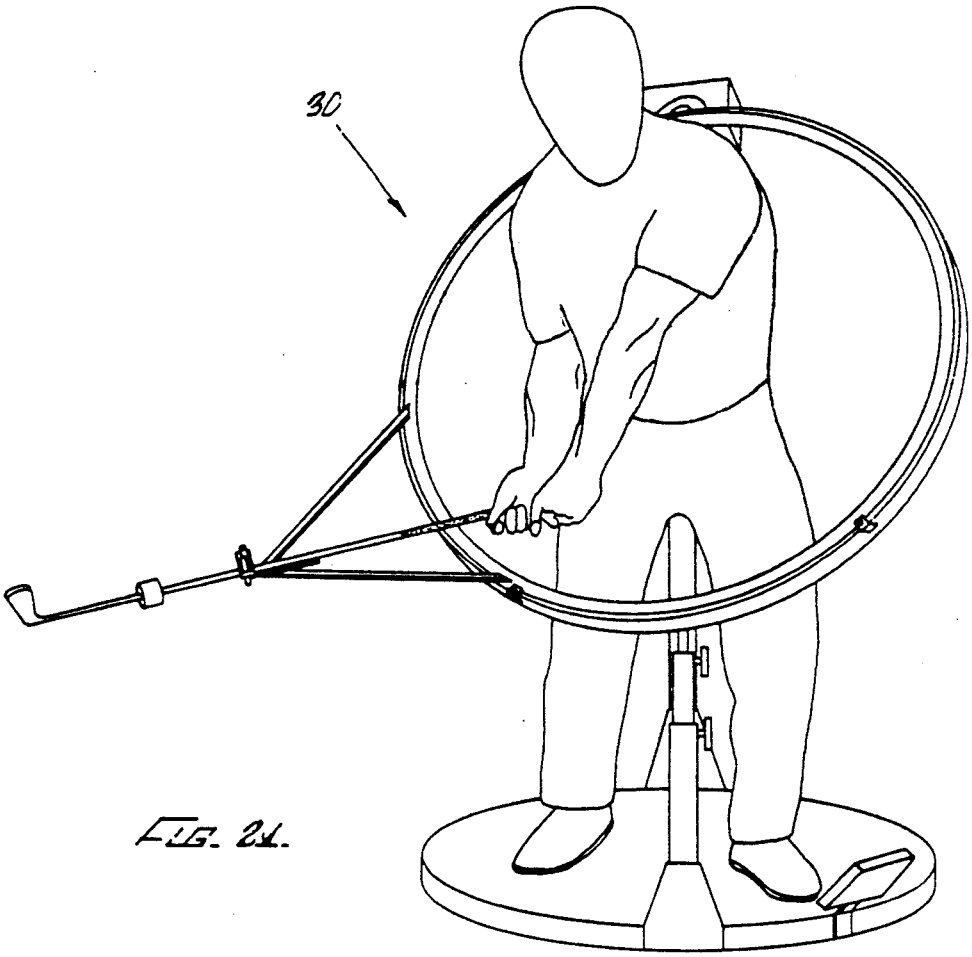
FIG. 21 is a perspective view of the downswing phase of the full-range of motion swing.

FIG. 21 shows initiation of the downswing wherein the club is pulled into action by the unwinding of the body and pulling of the front arm. The force applied to the tubular member 230 through the club shaft 312 causes the member 230 to rotate within the stationary angle member 220 in a direction opposite to its direction of rotation during the backswing. The club head traverses a swing path within the predetermined swing plane. Because the shaft can freely move longitudinally through the opening 300 up to the stop 316, the swing path traverses a non-circular arc.

Figure 22:
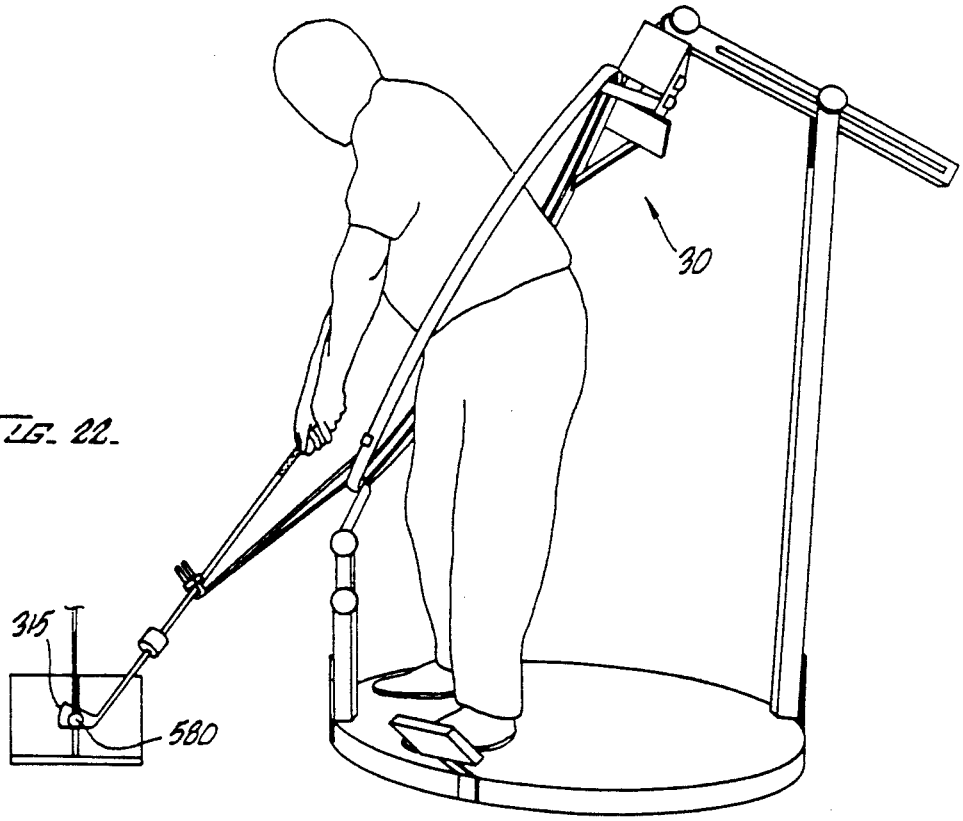
FIG. 22 is a perspective view of the hitting zone phase of the full-range of motion swing.

FIG. 22 Shows the hitting zone phase wherein the thrusting legs and hips are forcing the shoulders to turn, thereby accelerating the arms and club. The wrists are about to uncock and the back arm is beginning to straighten.

Figure 23:
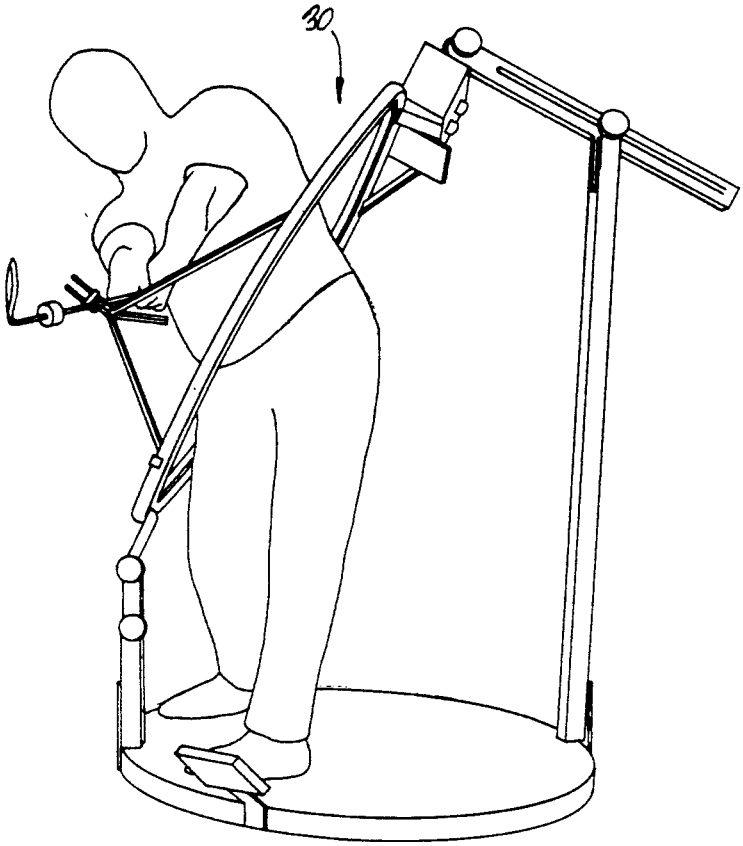
FIG. 23 is a perspective view of the impact phase of the full-range of motion swing.

FIG. 23 shows the impact phase where the arms have returned to their set-up phase position as the club head 315 is swung through the ball 580.

Figure 24:
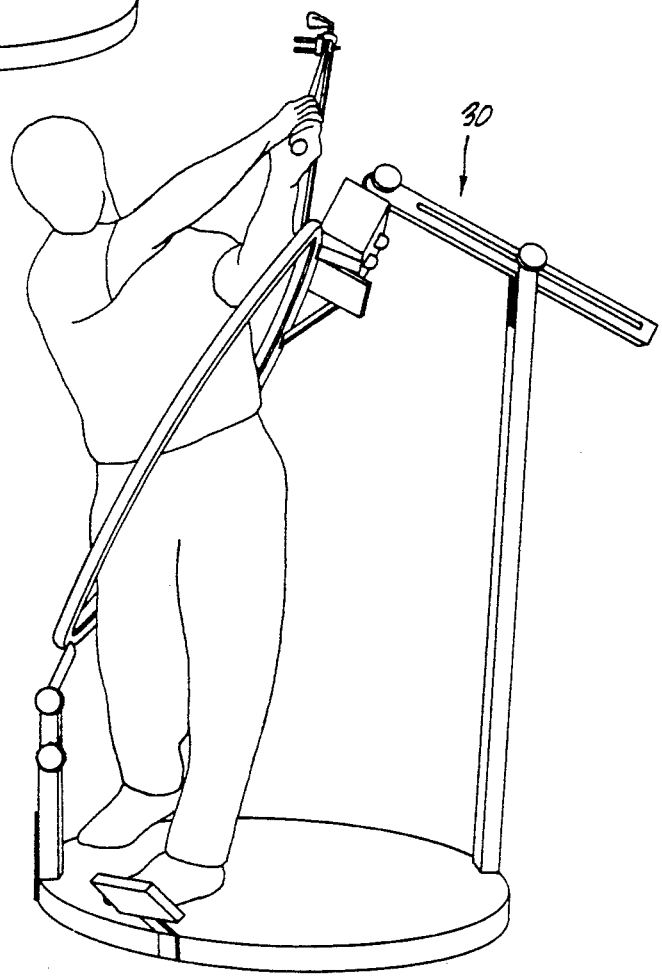
FIG. 24 is a perspective view of the release phase of the full-range of motion swing.

FIG. 24 shows the release phase where the back arm has straightened. The back forearm has pronated and the front forearm has supinated, the forearms being opposite to their rotational position at the top of the swing.

Figure 25:
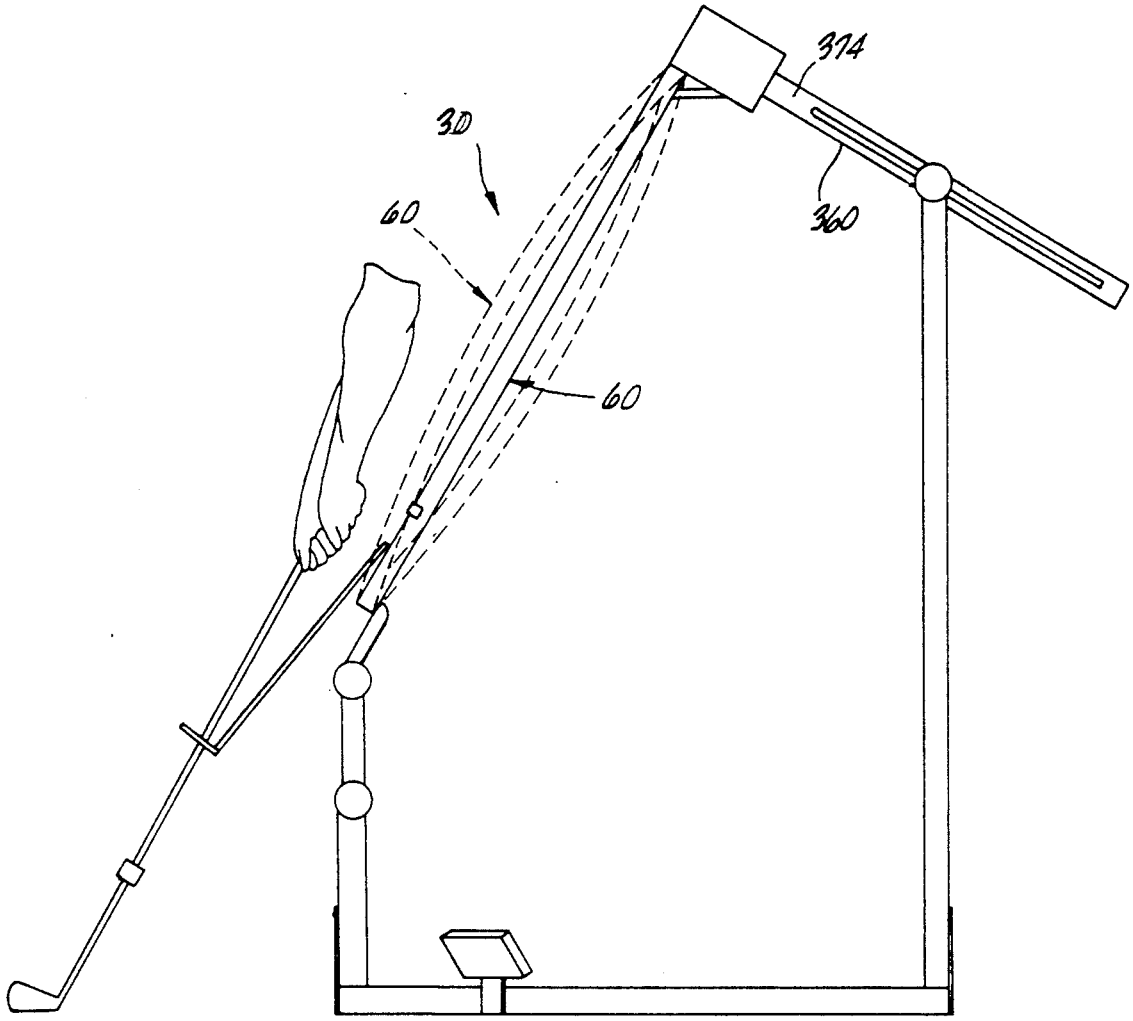
FIG. 25 is a perspective view of the follow-through 5 phase of the full-range of motion swing.
Figure 1:
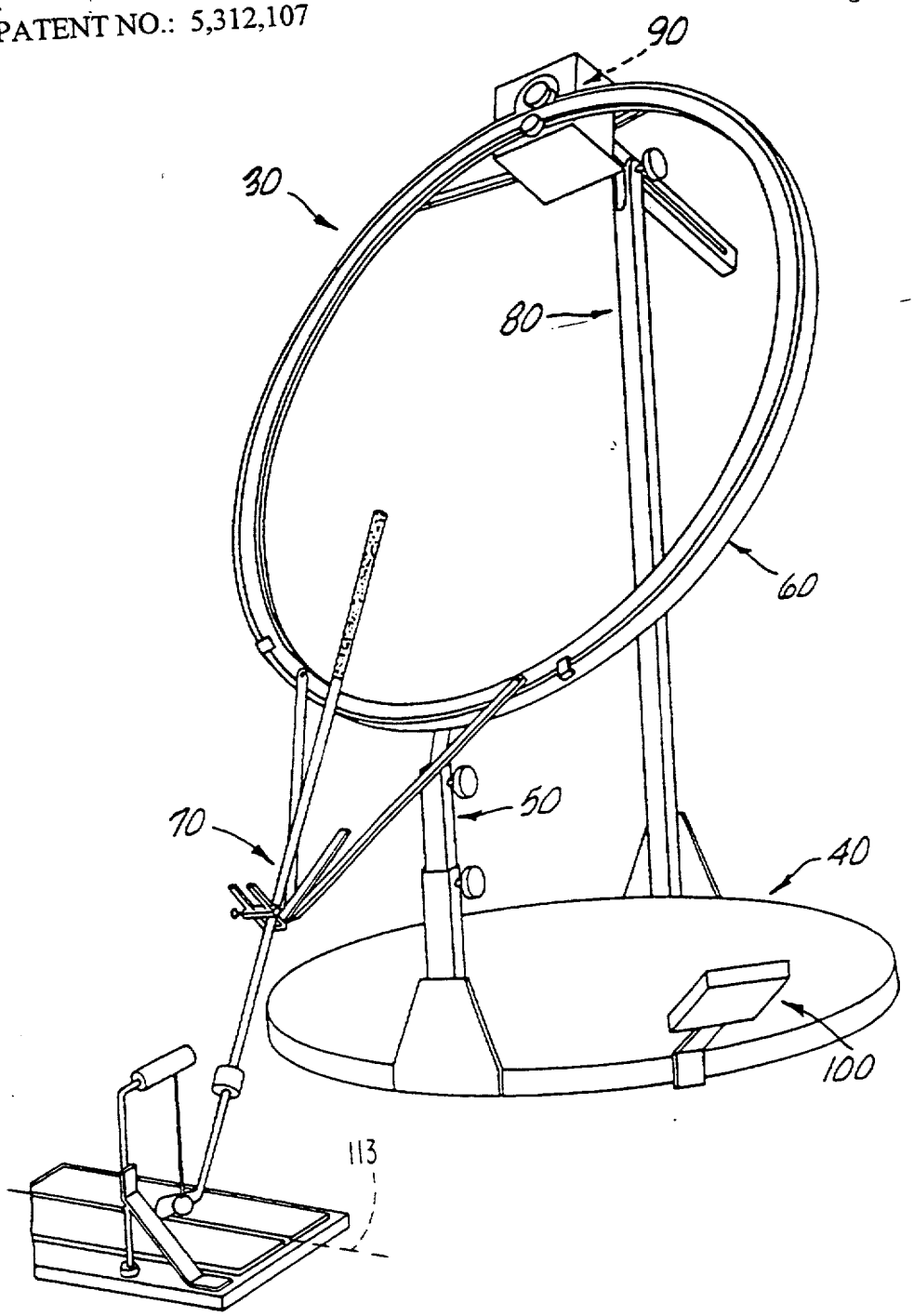
Figure 2:
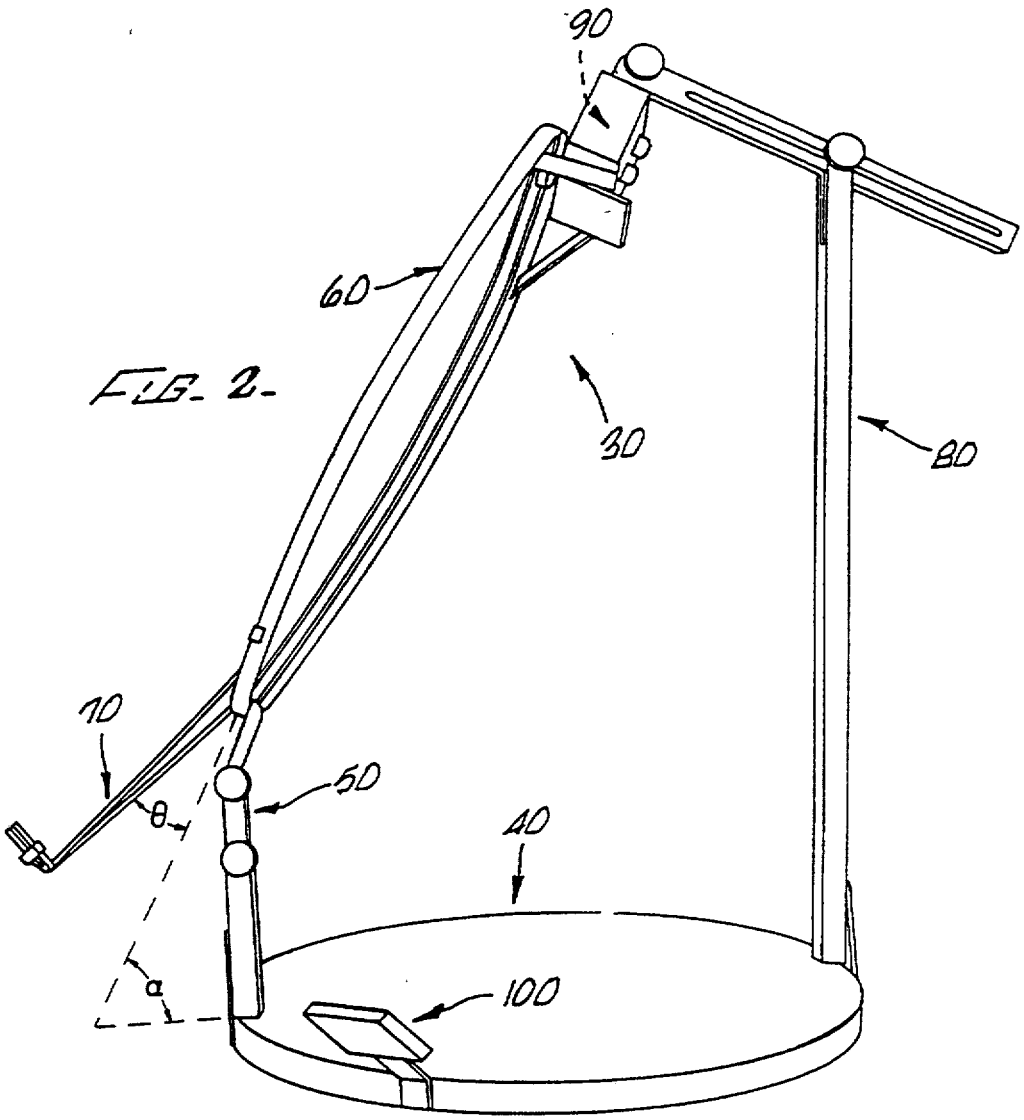
Figure 5:
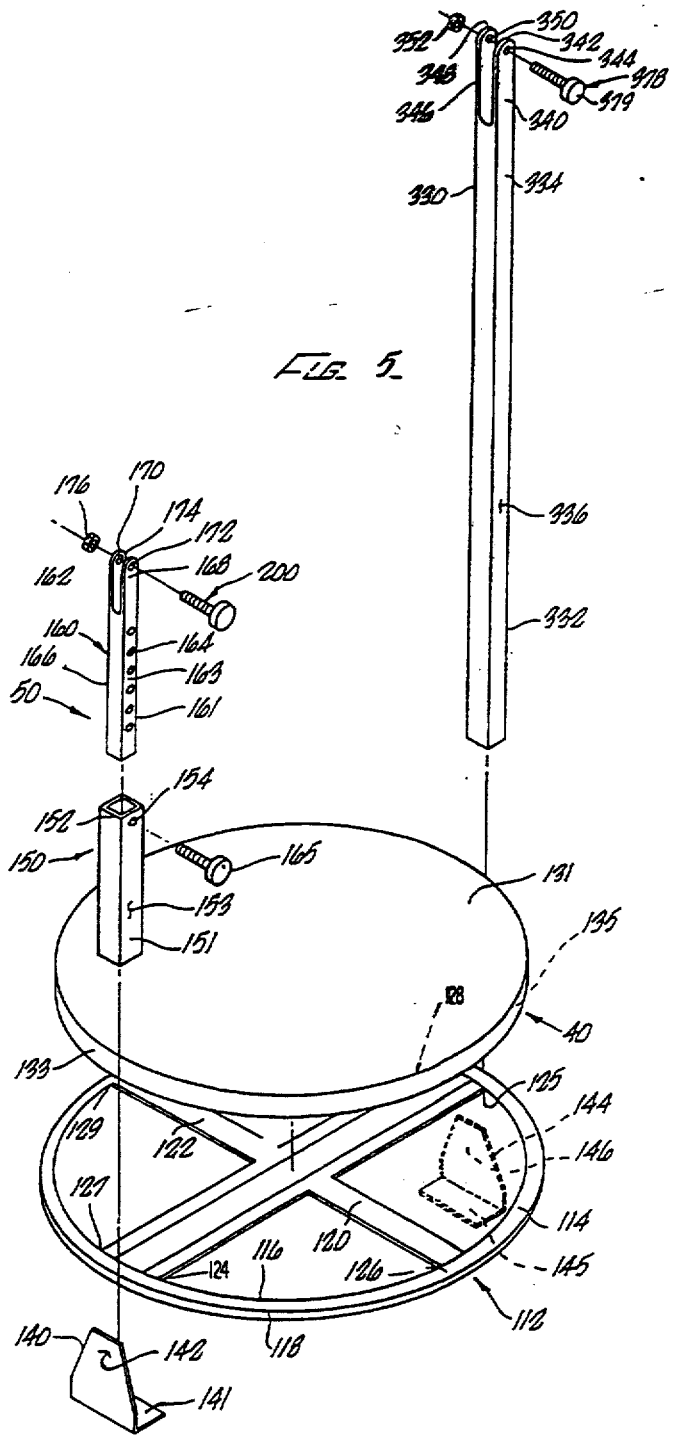
Figure 6:
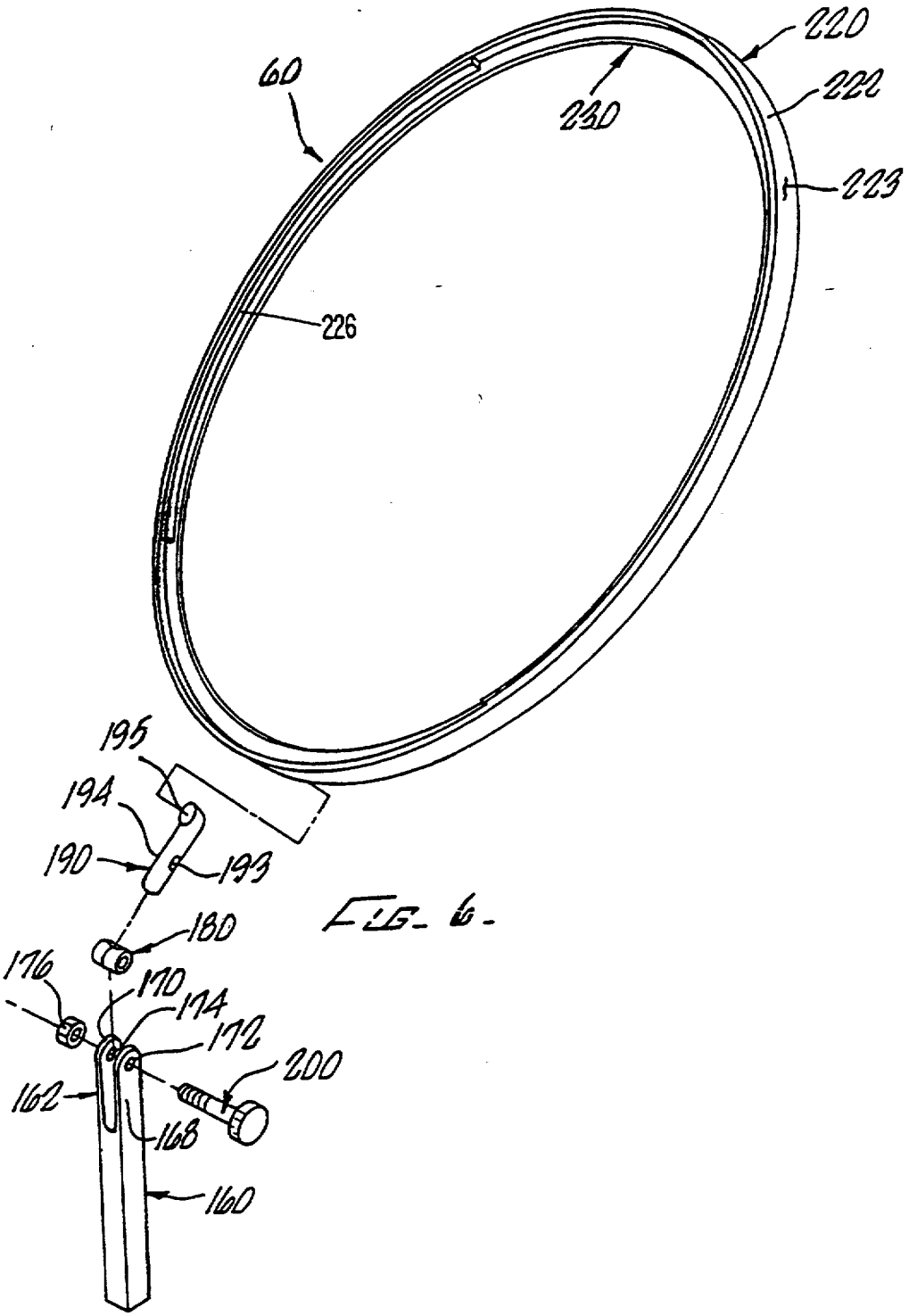
Figure 8:
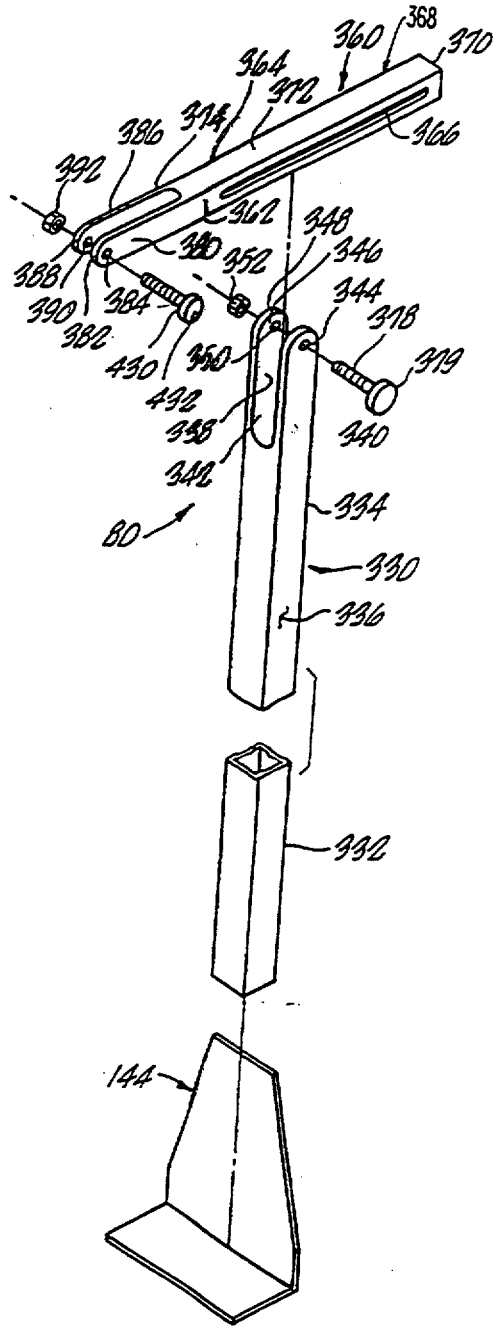
Figure 9:
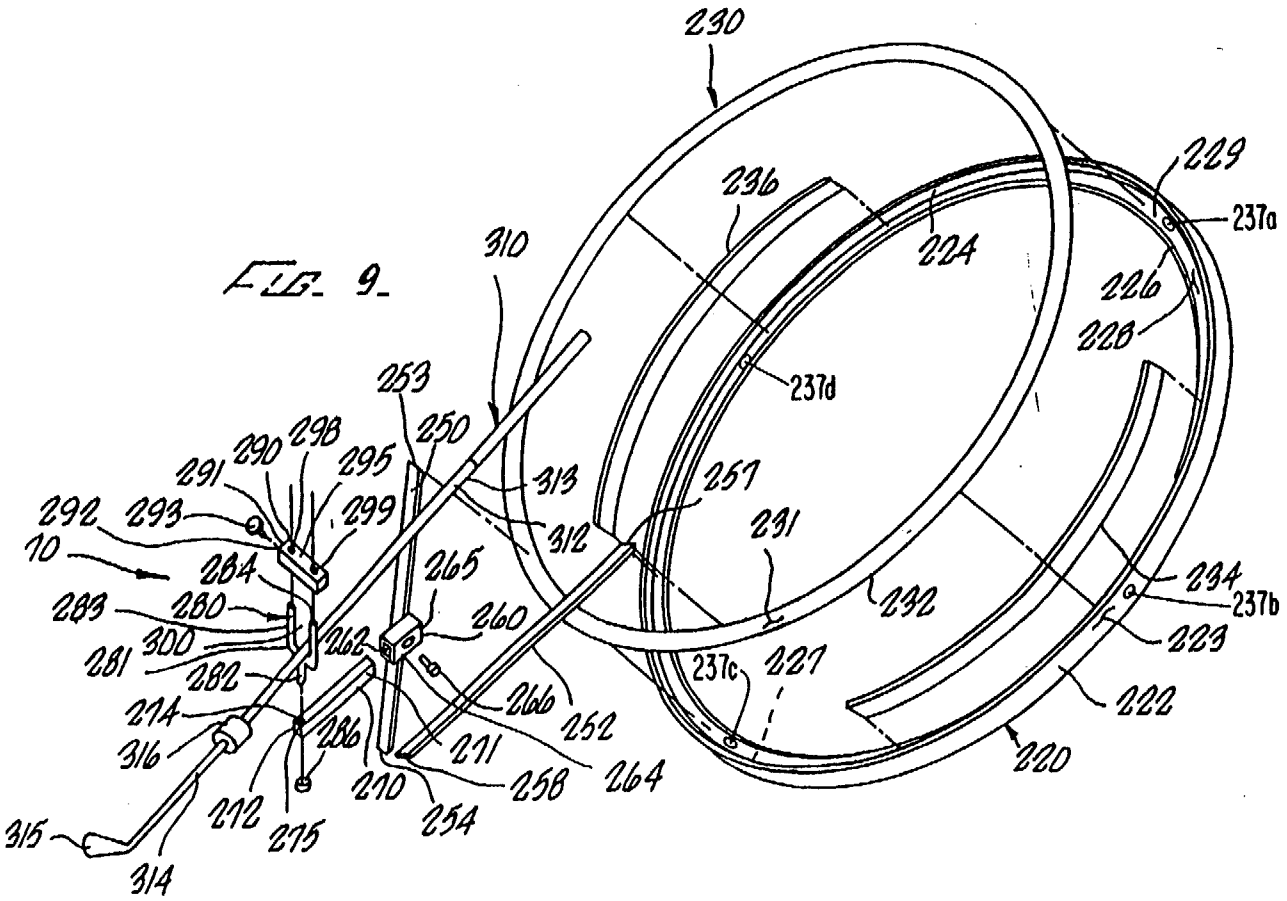
Figure 10:
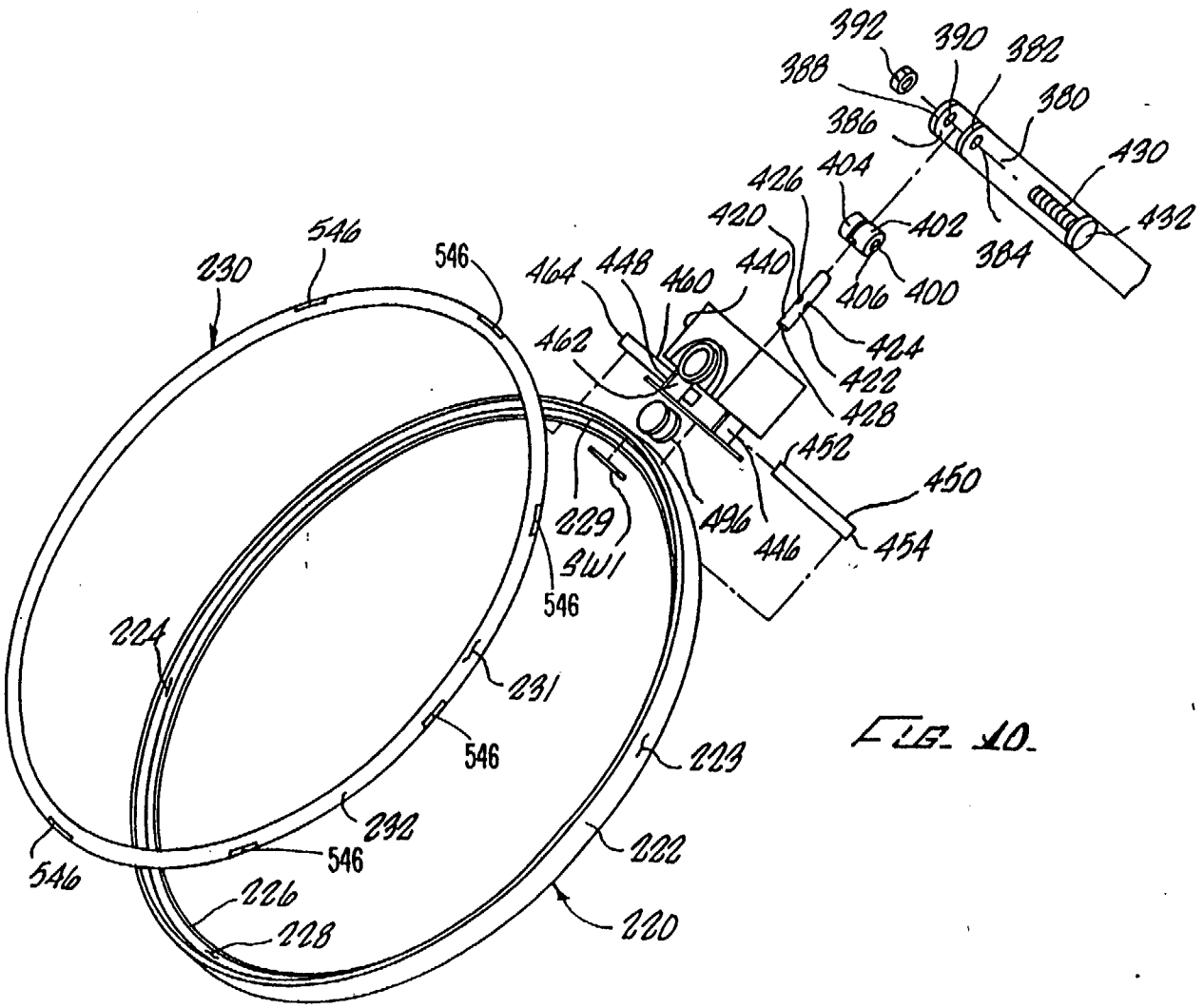
Figure 14:
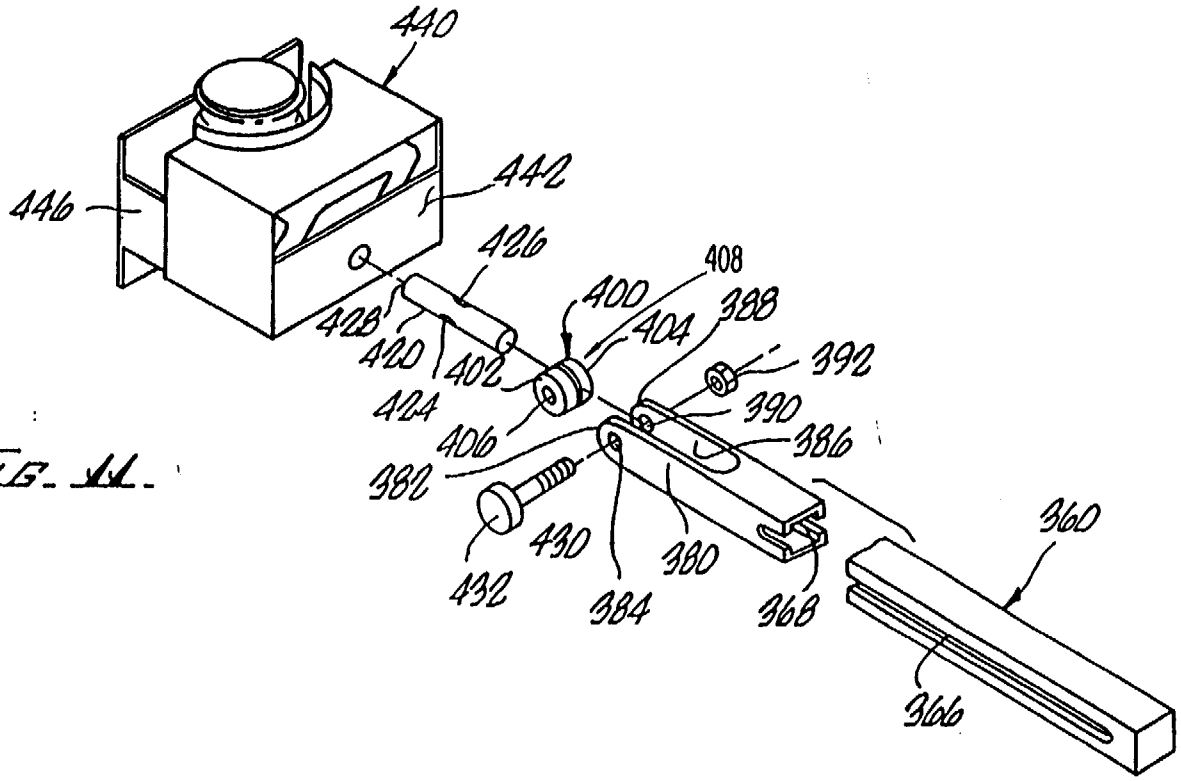
Figure 13:
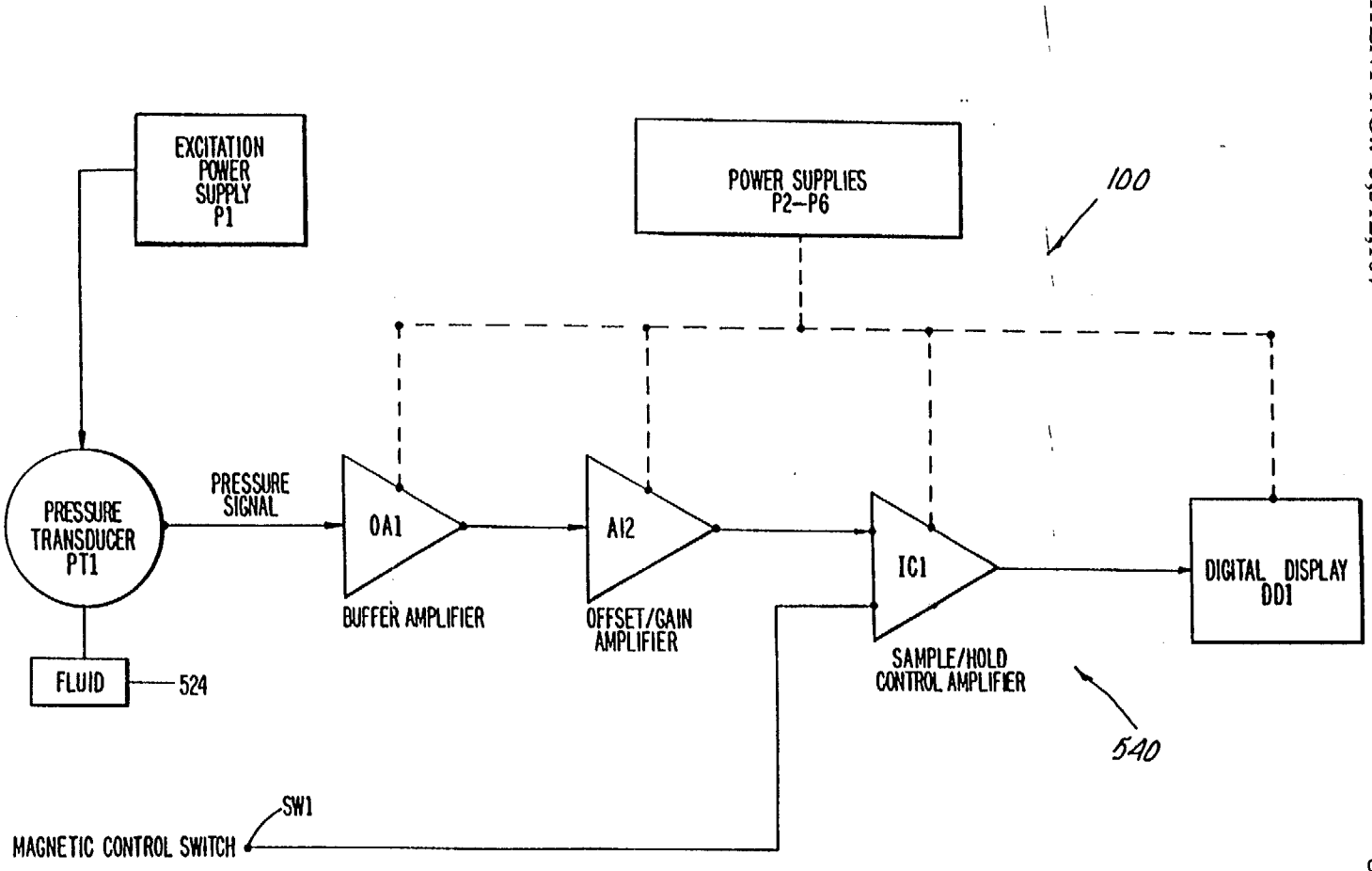
Figure 15:
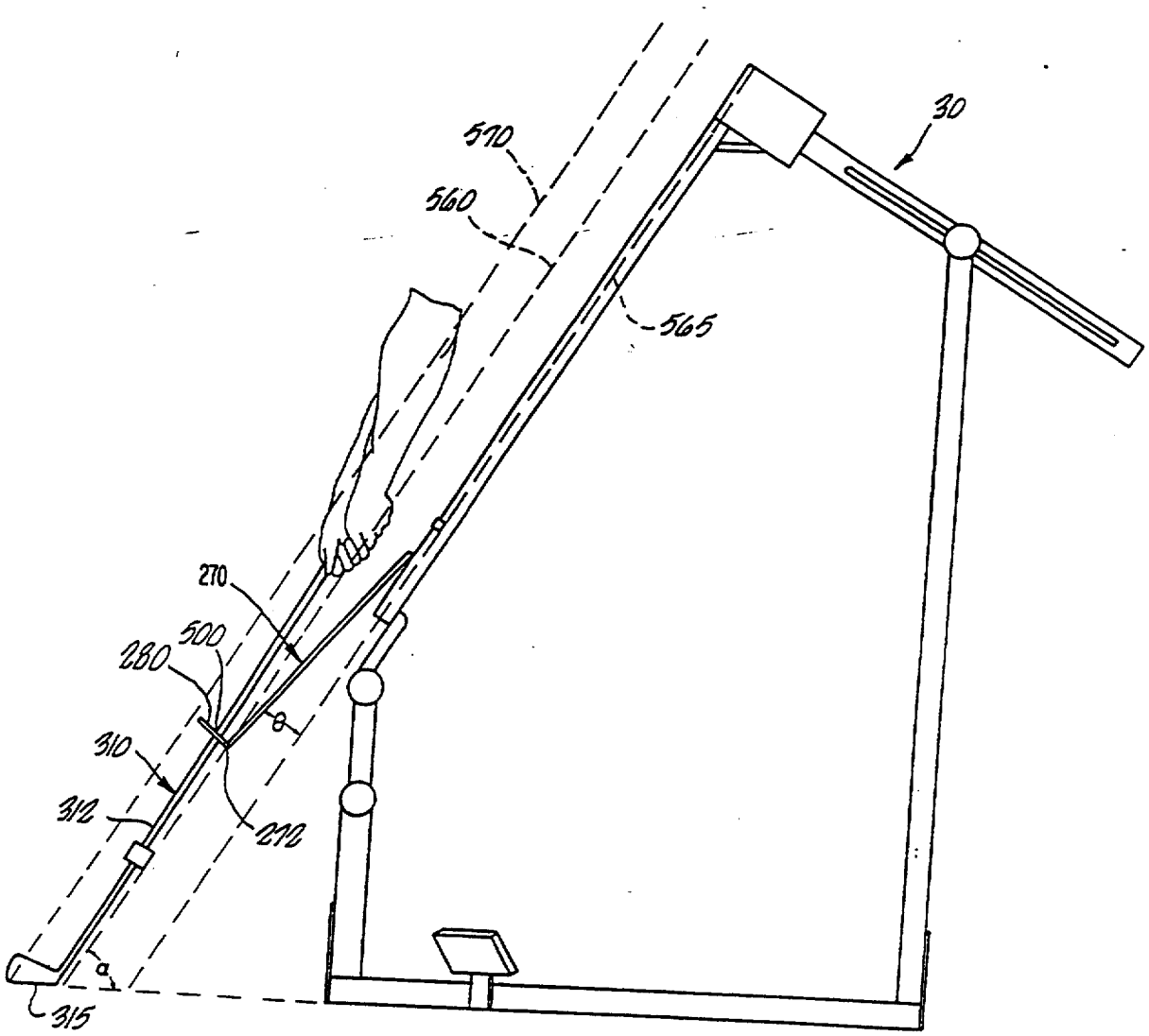
Figure 16:
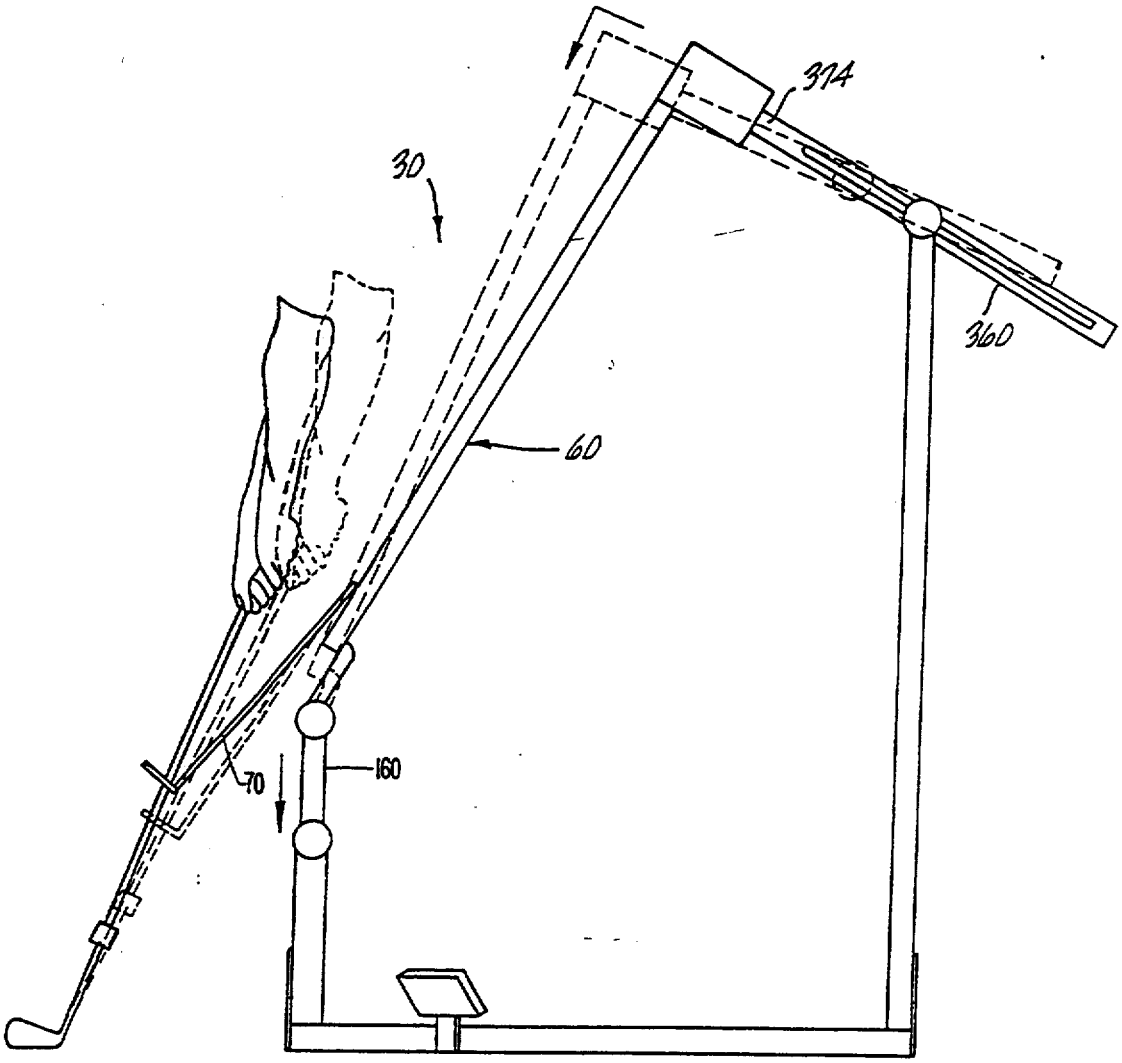
Figure 17:
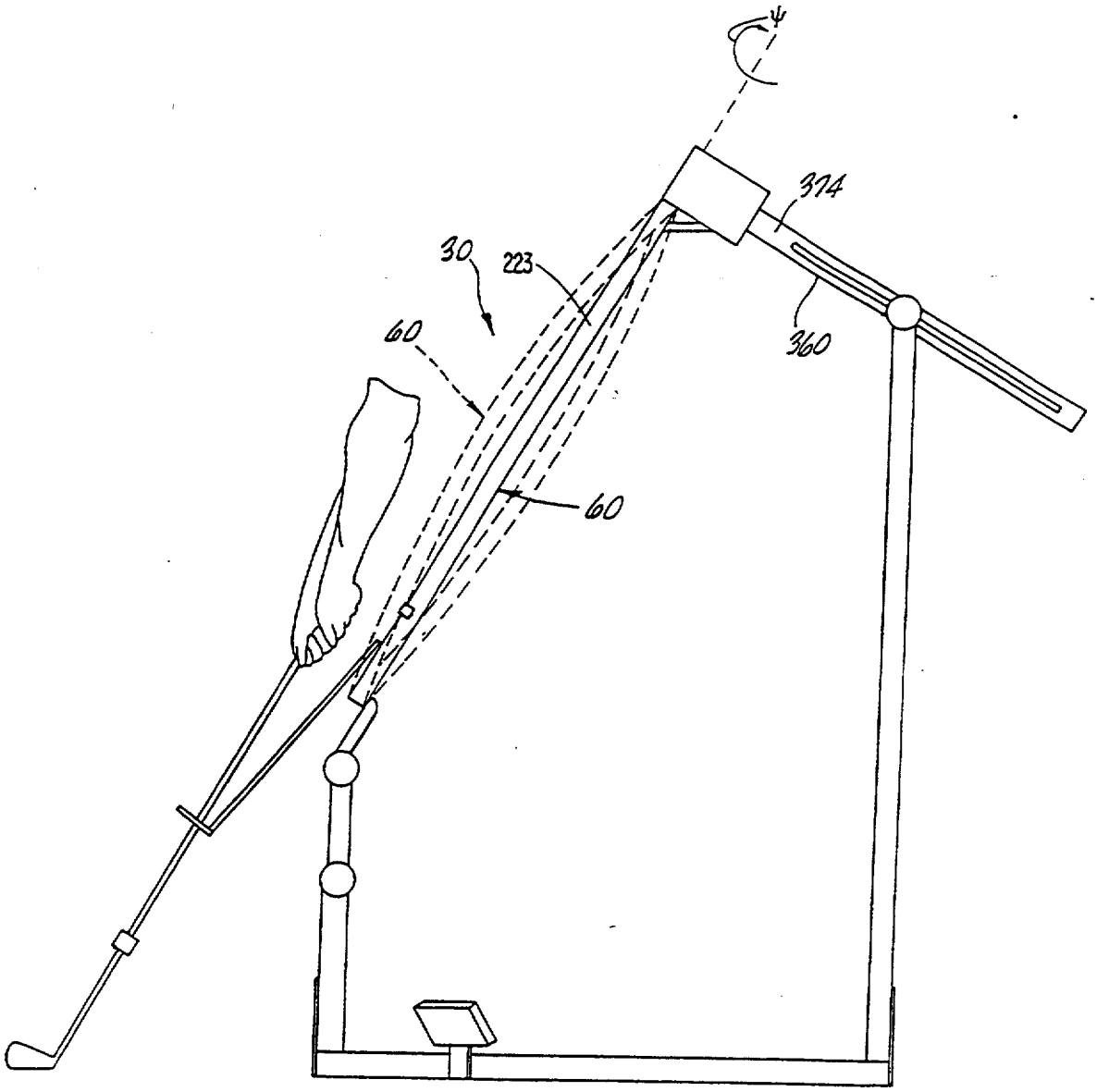
Figure 18:
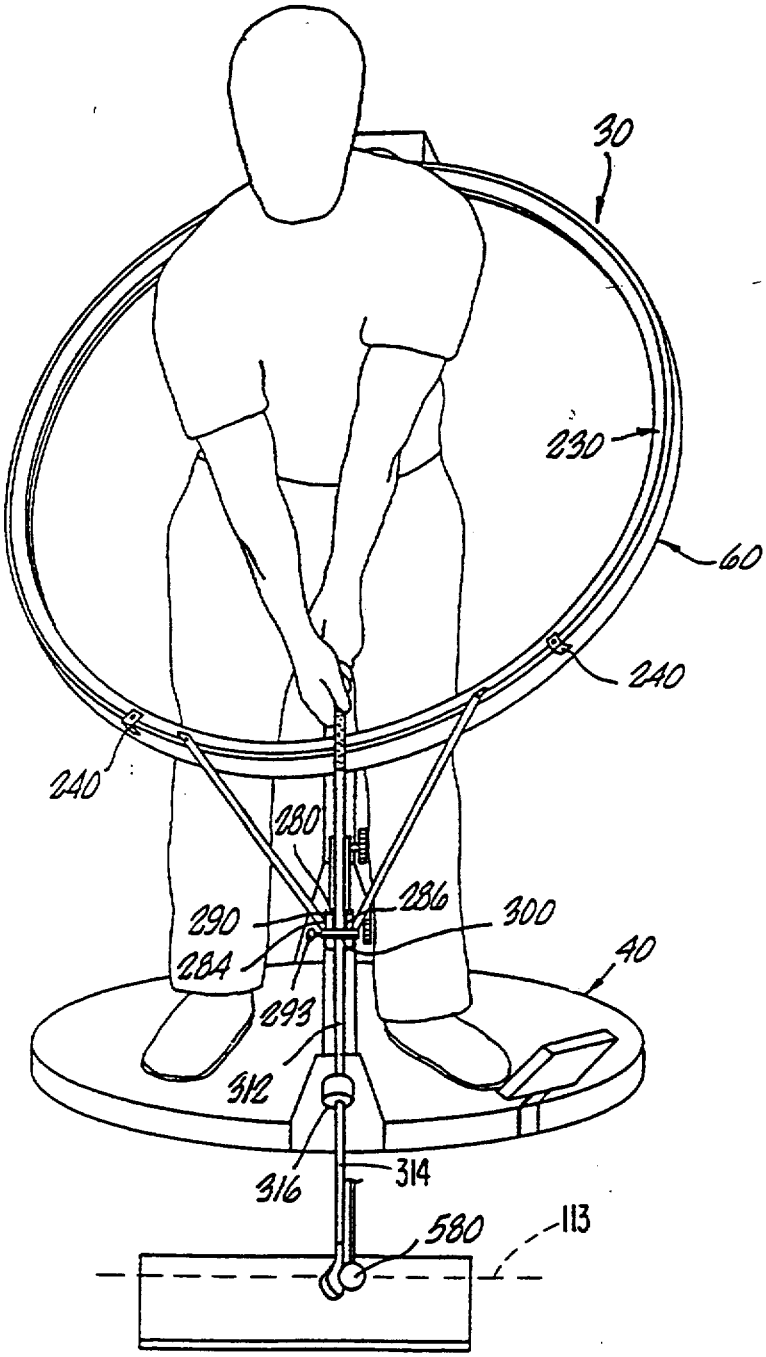
Figure 19:
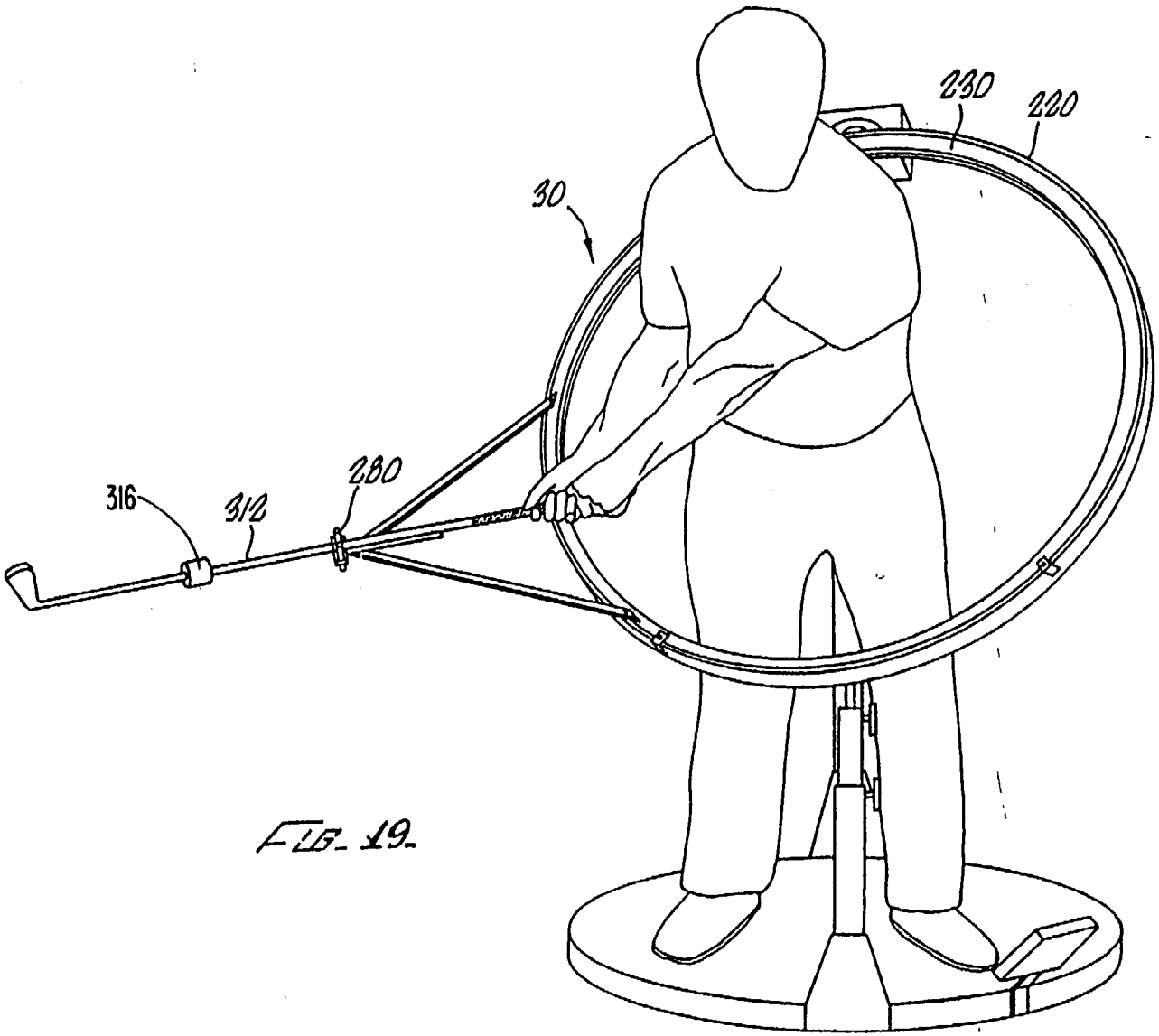
Figure 20:
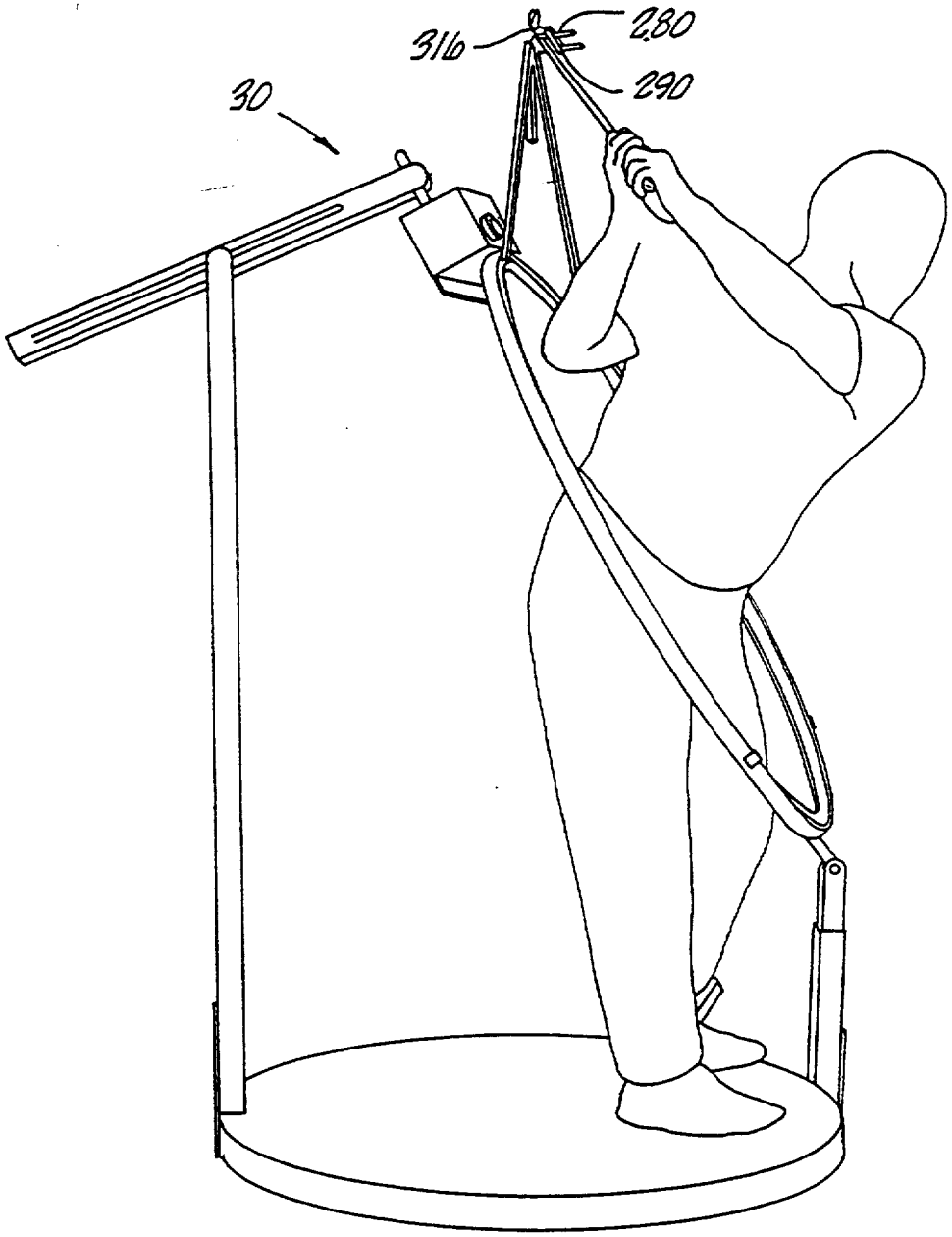
Figure 21:
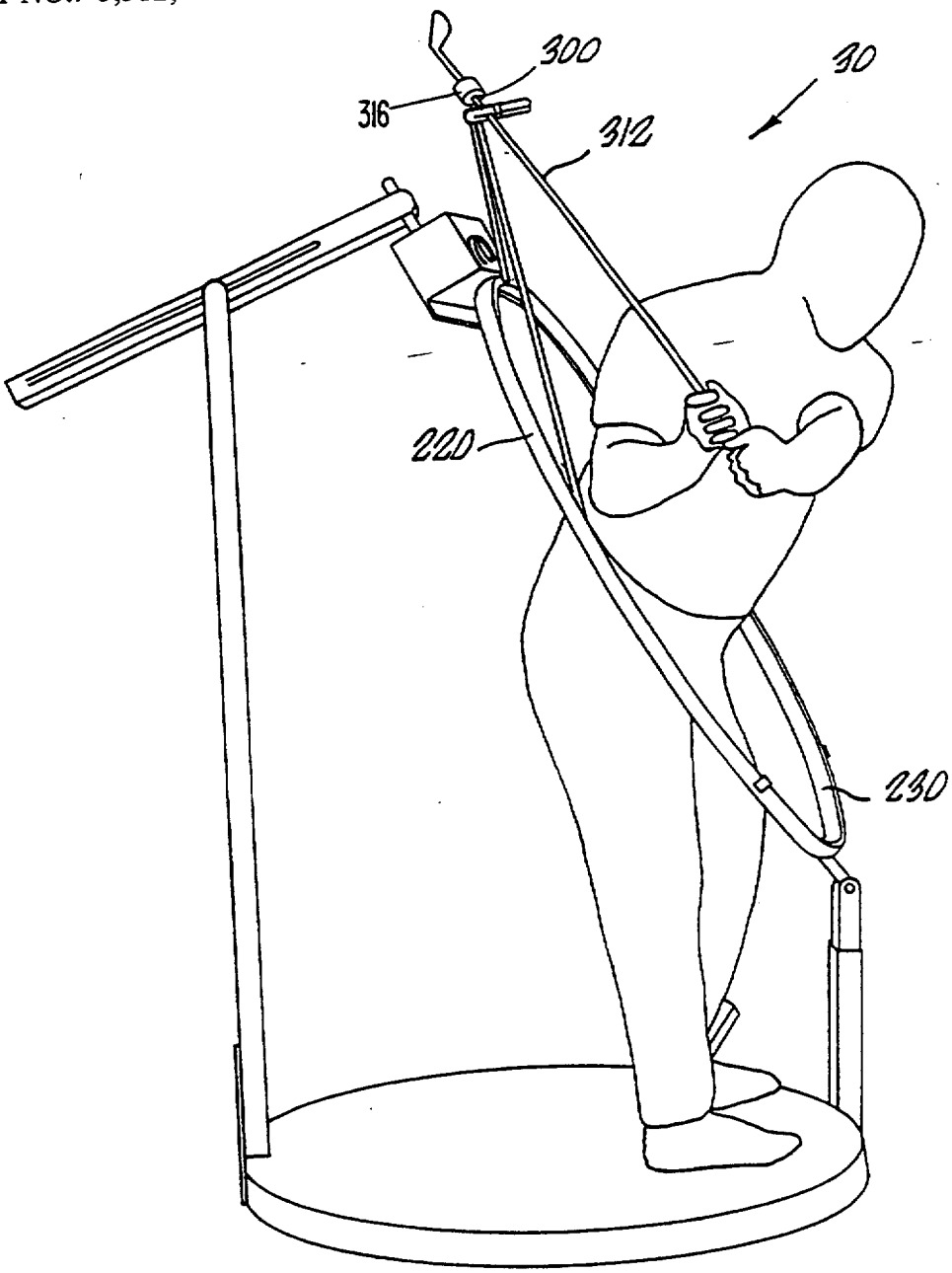
Figure 22:
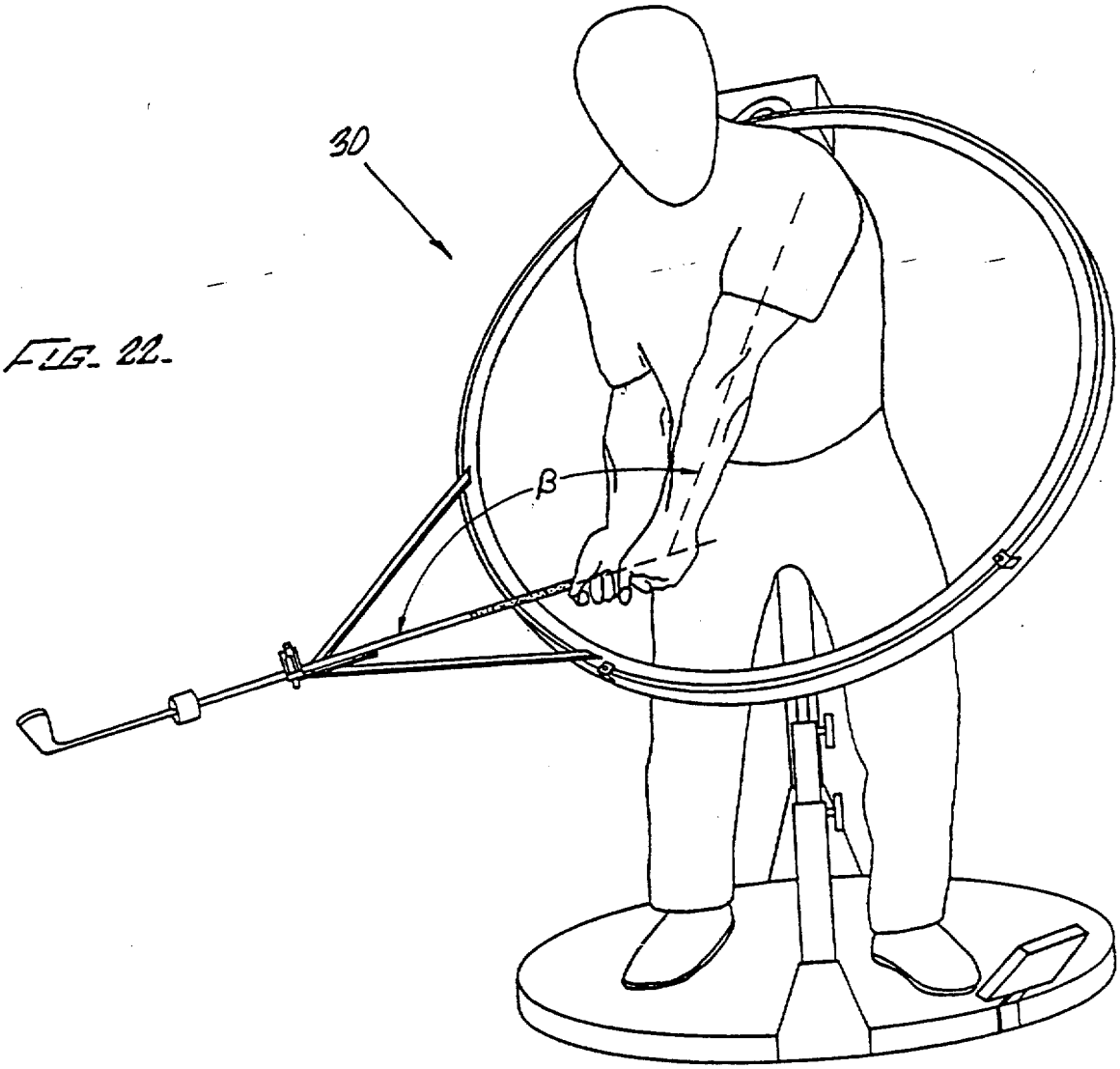
Figure 23:
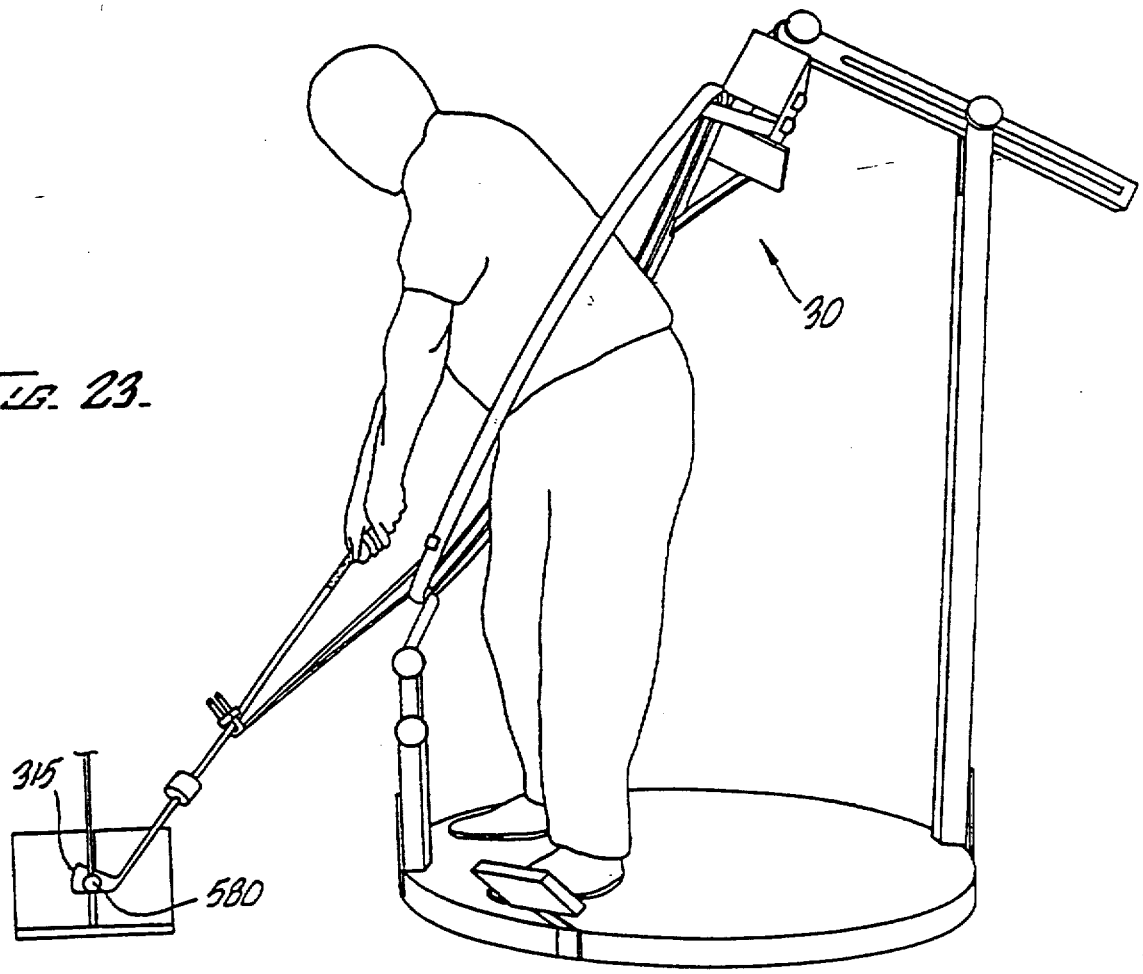
Figure 24:
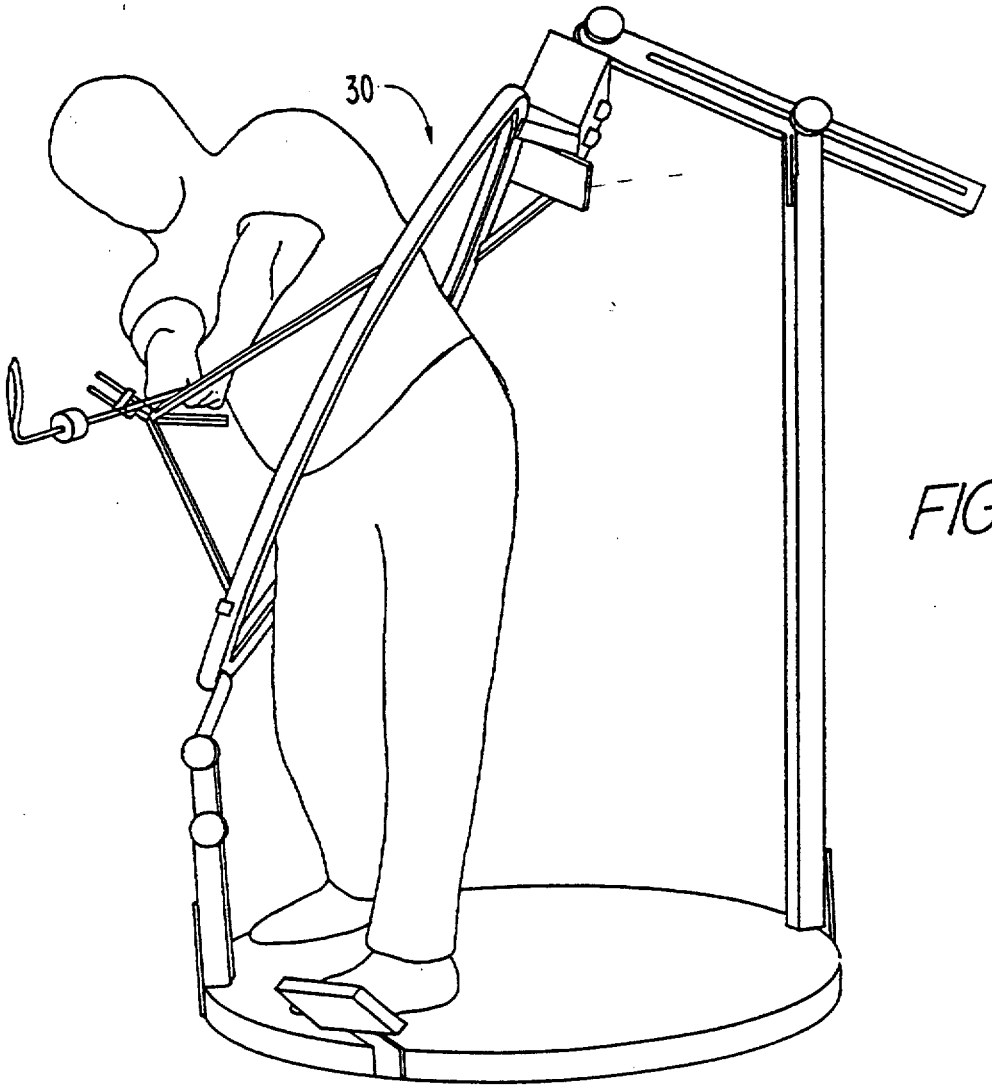
Figure 25:
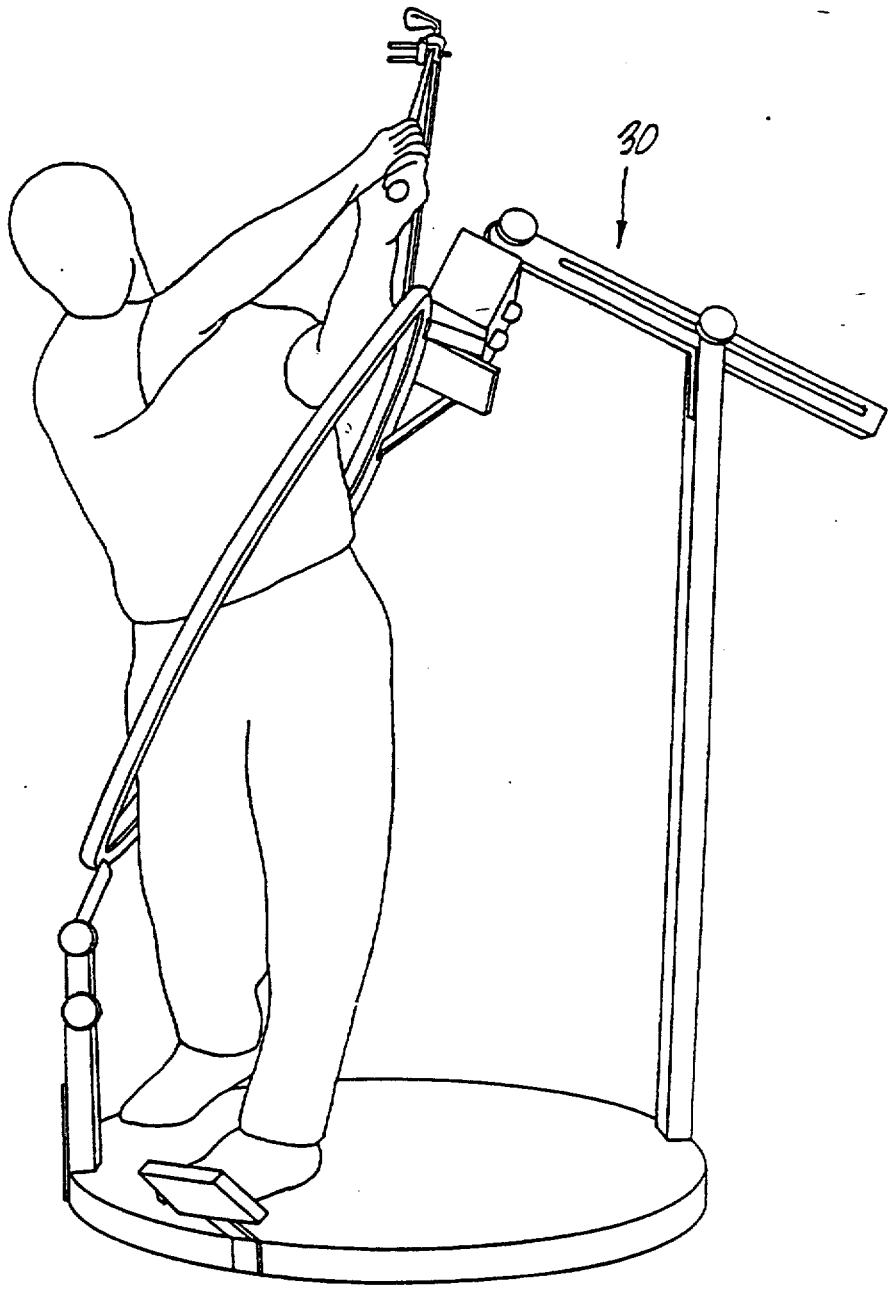

FIG. 25 shows the follow-through phase where the hips are facing toward the target and the torso has followed the turning of the hips and shoulders.

IV. Alternate Embodiments and Uses

Although the preferred embodiment of the present invention has been adapted for use as a golf swing training device, the invention is not so limited, but rather may be adapted for training and/or exercise in numerous sports swings, such as baseball, softball, tennis, cricket, racketball, squash, paddleball, etc.; as well as in therapeutic exercise of the arms and torso in swinging motions.

Minor sizing adaptations in the vertical support or stanchion sub-assemblies 50 and 80 at the front and rear of the base, or platform sub-assembly 40, respectively, would permit the positioning of the stationary and rotatable ring sub-assembly 60, of the present invention, for ideal strength conditioning and swing training of the baseball swing, the tennis swing, the badminton swing, the handball swing, the javelin throw, the discus throw, the shot put throw or any other upper extremity strength/mobility dominant sport. Minor alterations in the positioning and sizing of the stanchion sub-assemblies 50 and 8 would also permit the positioning of the ring sub-assembly 60 into a more vertical orientation with respect to the base sub-assembly 40 and would render the present invention ideal for strength conditioning and training of the football kick, the soccer kick, or any other lower extremity strength/mobility dominant sport. The club-holder sub-assembly 70 would also than be modified to accommodate a baseball bat, tennis racquet, etc.

Furthermore, such modifications in the present invention would also provide a device ideally suited for the rehabilitation of shoulder or hip joint injuries. The shoulder and hip joints are ball and socket type joints. The positioning and relative fragility of the shoulder joint ligaments permit a larger range of motion (mobility) of the shoulder joint as compared to positioning and density of the hip joint ligaments which limit mobility but provide increased stability of the hip joint. The shoulder joint is therefore susceptible to joint strains, sprains and dislocations, and the hip joint is susceptible to muscle ruptures and bony fractures. Rehabilitation of the ball and socket type joints of the shoulder and hip is best accomplished by a device which permits circumferential resistance training in a specific weakened movement plane and weakened movement path. The ring sub-assembly 60 of the present invention provides circumferential resistance training with isokinetic resistance and is thus ideally suited for the rehabilitation of shoulder and hip joint pathomechanics for five specific reasons: (1) the resistance is delivered throughout the entire joint range of motion; (2) the resistance varies directly with the user's ability to apply his or her maximum force to the rotatable ring 230 thereby permitting the user to self-administer the therapy/sport specific movement safely, avoiding an overstressing of the joint tissues; (3) the joint can be trained in the isolated/-specific plane and path of joint range of motion thereby allowing strength conditioning specific to the identified weakened tissues or specific to the sport-specific movement requirements; (4) the biofeedback provided by the electronic measurements derived from the rotating ring 230 provide the user with self-evaluation of his or her progress either from a sport-specific or rehabilitative aspect; and (5) the device permits the positioning of the actuator ring specific to the user's anatomical requirements and thereby permits the application of the therapy/exercise in the seated, standing or laying postures.

What is claimed is:

1. An exercise device adapted for use by a person, comprising:

a first ring having a predetermined diameter, an inner surface, and an outer surface;

a second ring concentric to the first ring and rotatably retained by the first ring;

means for providing isokinetic resistance to rotation of the second ring;

whereby a person applying torque in a first direction of rotation causes rotation of the second ring in the first direction of rotation against the isokinetic resistance.

2. The exercise device of claim 1, further comprising:

a planar base, adapted to support the person's weight when the base is horizontally disposed upon a floor;

means for adjustably altering an elevational position of the first ring with respect to the base;

means for adjustably altering an angle of inclination of the first ring with respect to the base, whereby a plane of rotation in which the second ring rotates is determined; and means for adjustably altering the azimuth of the plane of rotation of the second ring with respect to a preselected radial direction.

3. The exercise device of claim 2, wherein said means for adjustably altering an elevational position of the first ring with respect to the base comprises:

a generally vertical first stanchion of predetermined length having a lower portion rigidly attached to the planar base and an upper portion slidably retained within the first stanchion and rigidly connected to the first ring;

a generally vertical second stanchion of predetermined length having a lower portion rigidly attached to the planar base, and an upper portion rigidly connected to the first ring and slidably disposed within the lower portion of the second stanchion.

4. The exercise device of claim 3, further including means for rigidly maintaining a selected elevational position of the first ring with respect to the base comprising:

a lock adapted to fix the position of the lower portion of the first stanchion with respect to the upper portion of the first stanchion;

a first clamp disposed and rotatable in elevation within a longitudinal notch positioned in the upper portion of the first stanchion; and a first axle having a lower portion, an upper end, and a predetermined length, the lower portion disposed within the first clamp, and the upper end rigidly attached to the first ring.

5. The exercise device of claim 4, further comprising:

a second clamp disposed and rotatable in elevation within said second longitudinal notch positioned in the upper portion of the second stanchion; and a second axle having an upper portion, a lower end, and a predetermined length, the upper portion disposed within the second clamp, and the lower end rigidly attached to the first ring at a position diametrically opposite to the attachment position of the first axle.

6. The exercise device of claim 5 further comprising means for fixing the middle portion of the elongated member within said second longitudinal notch.

7. The exercise device of claim 2, wherein said means for adjustably altering the azimuth of the plane of rotation of the second ring with respect to a preselected radial direction comprises:

a first axle having a lower portion, an upper end, and a predetermined length, the upper end rigidly attached to the first ring;

a first clamp within which is disposed the lower portion of the first axle;

a second axle having an upper portion, a lower end, and a predetermined length, the lower end rigidly attached to the first ring; and

1 second clamp within which is disposed the upper portion of the second axle.

8. The exercise device of claim 7 further comprises:

first locking means for fixing the first axle within the first clamp; and second locking means for fixing the second axle within the second clamp.

9. The exercise device of claim 1, further comprising means for measuring force applied to the second ring.

10. The exercise device of claim 9, further comprising means for displaying said force in the form of force or power.

11. The exercise device of claim 10, wherein said means for displaying the measured force applied to the second ring comprises a light-emitting diode display.

12. The exercise device of claim 9, wherein said means for measuring force applied to the second ring comprises:

an electronic circuit with a magnetic switch having a steady state OFF position and a transient ON position, disposed on the first ring;

a plurality of permanent magnets disposed on the second ring adapted to individually trigger the magnetic switch from OFF to ON as each permanent magnet sequentially transits the magnetic switch during rotation of the second ring; and the electronic circuit adapted to produce an output signal voltage proportional to the instantaneous speed of the second ring as each of the magnets disposed on the second ring passes the magnetic switch on the first ring, the voltage amplitude measured when the magnetic switch changes state from OFF to ON.

13. The exercise device of claim 1, wherein said second ring further comprises a lever arm rigidly attached at a first end to the second ring and at the opposite end adapted to slidably retain an actuator.

14. The exercise device of claim 1, wherein said means for providing isokinetic resistance comprises an adjustable hydraulic clutch in frictional contact with the second ring.

15. The exercise device of claim 14, wherein said second means for providing isokinetic resistance comprises:

a hydraulic gear pump including an inlet port, an outlet port, and a drive-gear, the drive-gear operatively connected to the clutch;

a conduit connecting the inlet port and outlet port of the gear pump; and a valve having an adjustable aperture, the aperture disposed between the inlet port and outlet port whereby the rate of flow of hydraulic fluid through the conduit is proportional to the degree of opening of the aperture.

16. The exercise device of claim 1 further comprising:

a lever arm having a proximal portion, a distal portion, and a predetermined length, the proximal portion rigidly attached to the second ring; and a rigid shaft having a proximal portion, a middle portion, a distal portion, and a predetermined length, the proximal portion adapted to be gripped by the person, and the middle portion slidably constrained by and in frictional contact with the distal portion of the lever arm.

17. A golf swing training and muscle exercise device adapted for use by a person comprising:

a first arcuate member;

a second arcuate member concentric to and rotatably retained by the first arcuate member;

means for rotating the second member through a full range of motion of a golf swing and in response to a torque applied to the second arcuate member;

means for adjusting the maximum rotational speed of the second member;

a base, adapted to support the person's weight when the base is horizontally disposed upon a floor;

means for adjustably altering an elevational position of the second arcuate member with respect to the base;

means for adjustably altering an angle of inclination of the second member with respect to the base, whereby a plane of rotation is determined;

means for adjustably altering the azimuth of the plane of rotation with respect to a preselected radial direction;

means for measuring force applied to the second member;

means for displaying the magnitude of said measured force; and means for constraining the golf club swing to an arc in a plane substantially parallel to the plane of rotation of the second member.

18. The training and exercise device of claim 17, wherein the means for rotating the second arcuate member further comprises:

a lever arm having first and second struts; the struts each having first and second ends and predetermined lengths; the first ends joined at a common apex to a club-holder assembly which is adapted to slidably retain a golf club; and the second ends of the lever arm being rigidly attached to the second arcuate member.

19. The training and exercise device of claim 18, further comprising:

a one-way clutch in frictional contact with the second arcuate member;

a rotatable drive-shaft having a first end, a second end, and a predetermined length, the first end rigidly attached to the clutch;

a hydraulic gear pump including an inlet port, an outlet port, and a drive-gear, the drive-gear rigidly connected to the second end of the drive-shaft; and a conduit connecting the inlet port and the outlet port of the gear pump.

20. The training and exercise device of claim 19 further comprising:

a valve having an adjustable aperture, the aperture disposed between the inlet port and the outlet port whereby the maximum speed of rotation of the second arcuate member may be adjusted.

21. The training and exercise device of claim 17, wherein said means for constraining the club swing comprises an adjustable clamp rigidly attached to the second arcuate member and adapted to slidably retain a golf club shaft.

22. The training and exercise device of claim 17, wherein said means for adjustably altering an elevation position of the second arcuate member with respect to the base comprises:

a generally vertical first stanchion of predetermined length having a lower portion rigidly attached to the planar base and an upper portion slidably retained within the first stanchion member and rigidly connected to the first arcuate member;

a generally vertical second stanchion of predetermined length having a lower portion rigidly attached to the base, and an upper portion which is rigidly connected to the first arcuate member and is slidably disposed within the lower portion of the second stanchion member.

23. The training and exercise device of claim 17, further including means for rigidly maintaining a selected elevational position of the first arcuate member with respect to the base comprising:

a lock adapted to fix the position of the lower portion of the first stanchion with respect to the upper portion of the first stanchion;

a first clamp disposed and rotatable in elevation within a longitudinal notch positioned in the upper portion of the first stanchion; and a first axle having a lower portion, an upper end, and a predetermined length, the lower portion disposed within the first clamp, and the upper end rigidly attached to the first ring.

24. The training and exercise device of claim 23, further comprising:

a second clamp disposed and rotatable in elevation within said second longitudinal notch positioned in the upper portion of the second stanchion; and a second axle having an upper portion, a lower end, and a predetermined length, the upper portion disposed within the second clamp, and the lower end rigidly attached to the first arcuate member at a position diametrically opposite to the attachment position of the first axle.

25. The training and exercise device of claim 17, wherein said means for constraining the golf club swing comprises a lever-arm member disposed in a plane which is non-parallel to the plane of the second member.

26. The training and exercise device of claim 25, wherein a clamp is positioned at one end of the lever arm and the clamp is adapted to slidably retain the golf club.

27. An apparatus for constraining the head of a golf club during a full-range of motion golf swing, comprising:

a stationary ring having a predetermined diameter, an inner surface, and an outer surface, and disposed in a selected plane;

a rotatable ring having an inner surface and an outer surface; the outer surface coplanar with and in close proximity to the inner surface of the stationary ring; and the rotatable ring rotatably retained by the stationary ring;

a golf club holder having first and second struts, the struts each having first and second ends and predetermined lengths, the first ends joined at a common apex, the second ends rigidly attached to the rotatable ring, and the struts disposed in a plane non-parallel to the plane of rotation of the rotatable ring.

* * * * *

UNITED STATES PATENT AND TRADEMARK OFFICE

CERTIFICATE OF CORRECTION

PATENT NO. : 5,312,107

DATED : May 17, 1994

INVENTOR(S) : Ned Gvoich and John S. Moroz

It is certified that error appears in the above-indentified patent and that said Letters Patent is hereby corrected as shown below:

Column 1, line 58 replace "FIG. 18" WITH -- FIGS. 1 and 18; and
Column 13, line 15 after "first and" insert -- second --.

Figure 2:
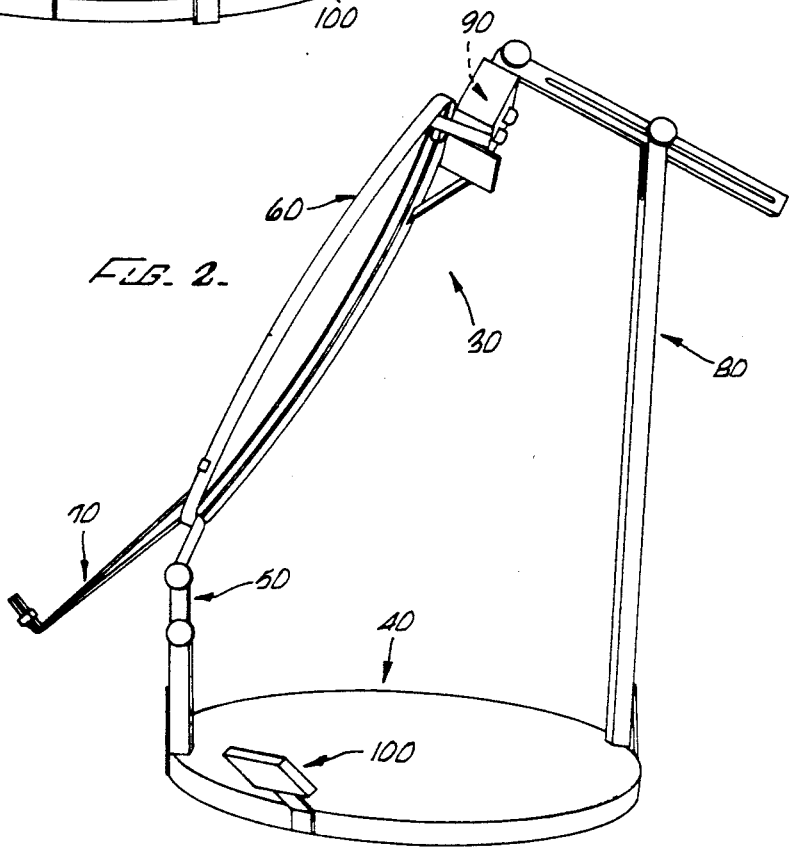
FIG. 2 is a side elevational view of the FIG. 1 embodiment.
Figure 3:
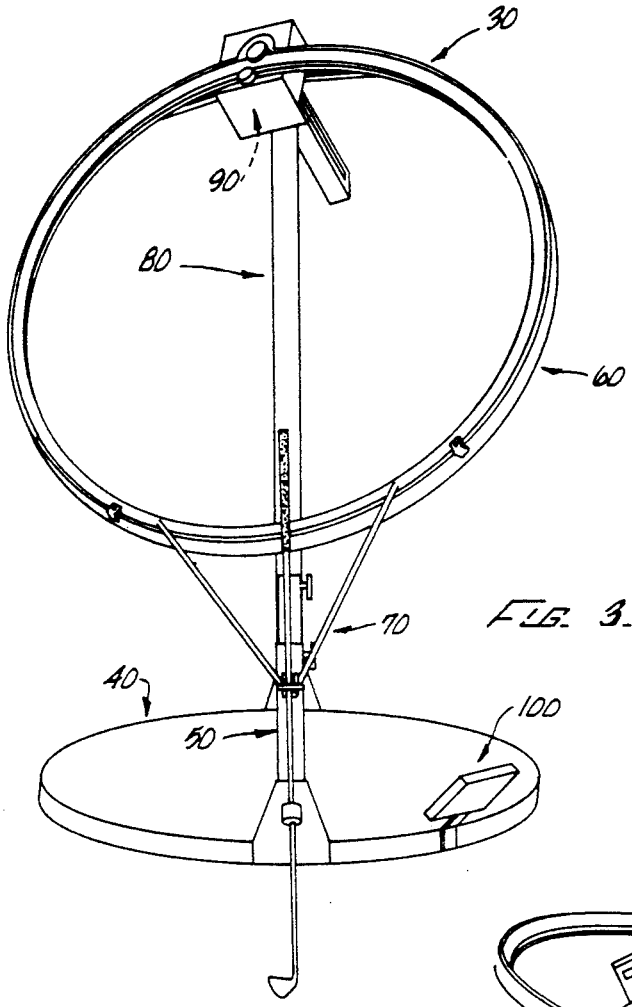
FIG. 3 is a front elevational view of the FIG. 1 embodiment.
Figure 4:
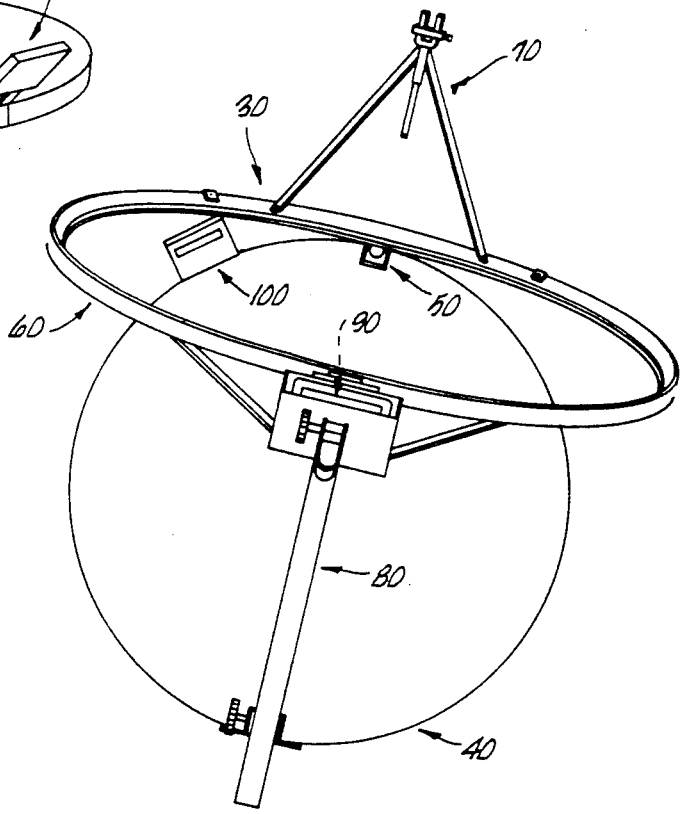
FIG. 4 is a top plan view of the FIG. 1 embodiment.

In the Drawings:

Sheet 1, FIGS. 1 and 2;
Sheet 3, FIGS. 5 and 8;
Sheet 4, FIGS. 6 and 11;
Sheet 5, FIGS. 9 and 10;
Sheet 7, FIG. 13;
Sheet 9, FIG. 15;
Sheet 10, FIG. 16;
Sheet 11, FIGS. 17 and 18;
Sheet 12, FIG. 19;
Sheet 13, FIG. 20;
Sheet 14, FIGS. 21 and 22;
Sheet 15, FIGS. 23 and 24; and
Sheet 16, FIG. 25 should appear as shown on the following pages.

Signed and Sealed this

Twentieth Day of August, 1996

*Attest:*

Bruce Lehman

BRUCE LEHMAN

*Attesting Officer*

*Commissioner of Patents and Trademarks*

--

PATENT NO.: 5,312,107

PATENT NO.: 5,312,107